US009387505B2

(12) United States Patent
Krogman et al.

(10) Patent No.: US 9,387,505 B2
(45) Date of Patent: Jul. 12, 2016

(54) METHODS, MATERIALS AND APPARATUS FOR IMPROVING CONTROL AND EFFICIENCY OF LAYER-BY-LAYER PROCESSES

(71) Applicant: Eastman Chemical Company, Kingsport, TN (US)

(72) Inventors: Kevin Krogman, Santa Clara, CA (US); J. Wallace Parce, Palo Alto, CA (US); Melissa Fardy, San Jose, CA (US); Siglinde Schmid, Belmont, CA (US); Thomas Workman, San Jose, CA (US); Thomas Fong, San Francisco, CA (US); William E. Jarvis, Millbrae, CA (US); Benjamin Wang, Mountain View, CA (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

(21) Appl. No.: 14/024,649

(22) Filed: Sep. 12, 2013

(65) Prior Publication Data

US 2014/0079884 A1 Mar. 20, 2014

Related U.S. Application Data

(60) Provisional application No. 61/702,112, filed on Sep. 17, 2012.

(51) Int. Cl.

| | |
|---|---|
| ***B05D 1/02*** | (2006.01) |
| ***B05D 1/36*** | (2006.01) |
| ***B05D 7/00*** | (2006.01) |
| *B05D 1/32* | (2006.01) |

(52) U.S. Cl.

CPC .. *B05D 1/02* (2013.01); *B05D 1/36* (2013.01); *B05D 7/56* (2013.01); *B05D 1/32* (2013.01); *B05D 2252/02* (2013.01)

(58) Field of Classification Search

CPC ..... B05D 1/02
USPC ..... 427/352
See application file for complete search history.

(56) References Cited

U.S. PATENT DOCUMENTS

| | | | |
|---|---|---|---|
| 3,978,264 | A | 8/1976 | Tarbell et al. |
| 4,410,501 | A | 10/1983 | Taramasso et al. |

(Continued)

FOREIGN PATENT DOCUMENTS

| | | | |
|---|---|---|---|
| EP | 1 046 068 | | 5/2003 |
| EP | 2 130 844 | A1 | 12/2009 |

(Continued)

OTHER PUBLICATIONS

Co-pending U.S. Appl. No. 14/569,955, filed Dec. 15, 2014, Nand et al.

(Continued)

*Primary Examiner* — Dah-Wei D Yuan
*Assistant Examiner* — Kristen A Dagenais
(74) *Attorney, Agent, or Firm* — John P. Foryt

(57) ABSTRACT

The disclosure provides materials, apparatuses, and methods for making multilayer coatings with a high degree of efficiency and control. In some aspects, for example, coatings are described having multiple layers of nanoparticles and a polyelectrolyte, wherein the nanoparticles form tightly packed monolayers. The interface between monolayers may include polyelectrolyte material. One or more aspects of such monolayers and interfaces are controllable.

15 Claims, 6 Drawing Sheets

(56) References Cited

U.S. PATENT DOCUMENTS

| | | | |
|---|---|---|---|
| 4,973,511 | A | 11/1990 | Farmer et al. |
| 5,019,197 | A | 5/1991 | Henderson |
| 5,091,258 | A | 2/1992 | Moran |
| 5,264,058 | A | 11/1993 | Hoagland et al. |
| 5,925,228 | A | 7/1999 | Panitz et al. |
| 6,221,112 | B1 | 4/2001 | Snider |
| 6,627,175 | B2 | 9/2003 | Schoebrechts |
| 7,311,943 | B2 | 12/2007 | Jacobson et al. |
| 8,234,998 | B2 | 8/2012 | Krogman et al. |
| 8,277,899 | B2 | 10/2012 | Krogman et al. |
| 8,689,726 | B2 | 4/2014 | Krogman et al. |
| 2001/0046564 | A1 | 11/2001 | Kotov |
| 2001/0048975 | A1 | 12/2001 | Winterton et al. |
| 2003/0167878 | A1 | 9/2003 | Al-Salim et al. |
| 2005/0019550 | A1 | 1/2005 | McGurran et al. |
| 2005/0025976 | A1 | 2/2005 | Faris |
| 2006/0029634 | A1 | 2/2006 | Berg et al. |
| 2006/0234032 | A1 | 10/2006 | Morrison et al. |
| 2007/0032869 | A1 | 2/2007 | Gilliard et al. |
| 2007/0054194 | A1 | 3/2007 | Zhang et al. |
| 2007/0104922 | A1 | 5/2007 | Zhai et al. |
| 2008/0060302 | A1 | 3/2008 | Bletsos et al. |
| 2008/0299036 | A1 | 12/2008 | Vitner et al. |
| 2009/0015908 | A1 | 1/2009 | Ando et al. |
| 2009/0153953 | A1 | 6/2009 | Banerjee et al. |
| 2009/0155545 | A1 | 6/2009 | Purdy et al. |
| 2009/0161220 | A1 | 6/2009 | Banerjee et al. |
| 2009/0209665 | A1 | 8/2009 | Fu et al. |
| 2010/0003499 | A1* | 1/2010 | Krogman et al. ..... 428/323 |
| 2010/0092377 | A1 | 4/2010 | Scott et al. |
| 2010/0098902 | A1 | 4/2010 | Kotov et al. |
| 2010/0208349 | A1 | 8/2010 | Beer et al. |
| 2010/0209593 | A1 | 8/2010 | Banerjee et al. |
| 2010/0304150 | A1 | 12/2010 | Zheng et al. |
| 2010/0315693 | A1 | 12/2010 | Lam et al. |
| 2011/0014366 | A1 | 1/2011 | Nogueira et al. |
| 2011/0089018 | A1 | 4/2011 | Chang et al. |
| 2011/0135888 | A1 | 6/2011 | Xu et al. |
| 2011/0274767 | A1 | 11/2011 | Kato et al. |
| 2012/0028005 | A1 | 2/2012 | Zheng et al. |
| 2012/0082831 | A1 | 4/2012 | Wang et al. |
| 2012/0194819 | A1 | 8/2012 | Varma |
| 2013/0108832 | A1 | 5/2013 | Domercq et al. |
| 2013/0183516 | A1 | 7/2013 | Krogman et al. |
| 2013/0273242 | A1 | 10/2013 | Krogman et al. |
| 2014/0079922 | A1 | 3/2014 | Wang et al. |
| 2014/0218792 | A1 | 8/2014 | Krogman et al. |
| 2014/0220351 | A1 | 8/2014 | Krogman et al. |
| 2014/0242321 | A1 | 8/2014 | Schmid et al. |
| 2014/0242393 | A1 | 8/2014 | Olmeijer et al. |

FOREIGN PATENT DOCUMENTS

| | | | |
|---|---|---|---|
| EP | 2226364 | A1 | 9/2010 |
| EP | 2 343 579 | A1 | 7/2011 |
| GB | 2 198 739 | A | 6/1988 |
| JP | H 04 197427 | A | 7/1992 |
| JP | 11 292537 | A | 10/1999 |
| JP | 2008 041377 | A | 2/2008 |
| JP | 2010 132514 | A | 6/2010 |
| KR | 10-2004-0086912 | A | 10/2004 |
| KR | 10-2005-0059582 | A | 6/2005 |
| KR | 10-2011-0082625 | A | 7/2011 |
| WO | WO 2005/072947 | A1 | 8/2005 |
| WO | WO 2012/075309 | A1 | 6/2012 |

OTHER PUBLICATIONS

ASTM G173-03; Standard Tables for Reference Solar Spectral Irradiances: Direct Normal and Hemispherical on 37° Tilted Surface.
ASTM D1003-07; Standard Test Method for Haze and Luminous Transmittance of Transparent Plastics.
ASTM D1787-89; Standard Test Method for Pentosans in Cellulose.
ASTM D3359-09$^{E2}$; Standard Test Methods for Measuring Adhesion by Tape Test.
ASTM D4329-13; Standard Practice for Fluorescent Ultraviolet (UV) Lamp Apparatus Exposure of Plastics.
ASTM D4587-11; Standard Practice for Fluorescent UV-Condensation Exposures of Paint and Related Coatings.
Hennink et al.; "Novel crosslinking methods to design hydrogels"; Advanced Drug Delivery Reviews; vol. 54 (2002); pp. 13-36.
Krogman, et al.; "Automated Process for Improved Uniformity and Versatility of Layer-by-Layer Deposition"; Langmuir 2007, 23, pp. 3137-3141.
Lee et al.; "Formation of Nanoparticle-Loaded Microcapsules Based on Hydrogen-Bonded Multilayers"; Chem. Mater.; 2005, vol. 17; pp. 1099-1105.
Nolte, Adam John; "Fundamental Studies of Polyelectrolyte Multilayer Films: Optical, Mechanical, and Lithographic Property Control"; Thesis (PhD); Massachusetts Institute of Technology; Dept. of Materials Science and Engineering; Feb. 2007 (Abstract, pp. 32-29, Figure 2.3).
Rouse, et al.; "Sol-Gel Processing of Ordered Multilayers to Produce Composite Films of Controlled Thickness"; Chem. Mater.; 2000; 12; pp. 2502-2507.
Kim, et al.; "Synthesis and Structures of New Layered Ternary Manganese Tellurides: $AMnTe_2$ (a=K, Rb, Cs) $Na_3Mn_4Te_6$, and $NaMn_{1.56}Te_2$"; Inorg. Chem.; 1999; 38; pp. 235-242.
Kim, et al.; "Hydrothermal synthesis of titanium dioxides using basic peptizing agents and their photocatalytic activity"; Chemical Engineering Science; 62 (2007); pp. 5154-5159.
PCT International Search Report for International Application No. PCT/US2011/064397 with date of mailing Jun. 6, 2012.
PCT International Search Report for International Application No. PCT/US2012/025138 with date of mailing Oct. 30, 2012.
PCT International Search Report for International Application No. PCT/US2012/059147 with date of mailing Mar. 28, 2013.
PCT International Search Report for International Application No. PCT/US2012/062892 with date of mailing Mar. 29, 2013.
PCT International Search Report for International Application No. PCT/US2012/059142 with date of mailing Apr. 29, 2013.
PCT International Search Report for International Application No. PCT/US2013/059337 with date of mailing Dec. 6, 2013.
USPTO Office Action dated Jul. 23, 2014 in co-pending U.S. Appl. No. 13/633,809.
USPTO Office Action dated Feb. 11, 2015 in co-pending U.S. Appl. No. 13/633,809.
USPTO Office Action dated Jun. 5, 2015 in co-pending U.S. Appl. No. 13/861,368.
USPTO Office Action dated Jul. 8, 2015 in co-pending U.S. Appl. No. 14/246,084.
Cammarata, et al.; "Carbodiimide Induced Cross-Linking, Ligand Addition, and Degradation in Gelatin"; Molecular Pharmaceutics; 2015; 12; pp. 783-793.
USPTO Notice of Allowance dated Feb. 11, 2016 in co-pending U.S. Appl. No. 14/569,955.
USPTO Office Action dated Feb. 16, 2016 in co-pending U.S. Appl. No. 13/633,809.
USPTO Office Action dated Sep. 8, 2015 in co-pending U.S. Appl. No. 13/633,809.
USPTO Office Action dated Oct. 30, 2015 in co-pending U.S. Appl. No. 14/028,450.
Wu et al.; "Deformable Antireflection Coatings from Polymer and Nanoparticle Multilayers", Advanced Materials, 2006, 18, pp. 2699-2702.
USPTO Office Action dated Nov. 5, 2015 in co-pending U.S. Appl. No. 13/967,770.
USPTO Office Action dated Dec. 4, 2015 in co-pending U.S. Appl. No. 13/861,368.
USPTO Office Action dated Dec. 17, 2015 in co-pending U.S. Appl. No. 14/246,096.
USPTO Notice of Allowance dated Jan. 20, 2016 in co-pending U.S. Appl. No. 14/569,955.

* cited by examiner

METHODS, MATERIALS AND APPARATUS FOR IMPROVING CONTROL AND EFFICIENCY OF LAYER-BY-LAYER PROCESSES

CROSS-REFERENCE TO RELATED APPLICATIONS

This application claims priority to U.S. Provisional Patent Application Ser. No. 61/702,112, filed Sep. 17, 2012, the contents of which are incorporated herein by reference.

INTRODUCTION

Layer by layer (LbL) assembly is a process that builds surface coatings by alternately depositing two different and complementary materials. Alternation of the two materials forms bilayers, and bilayers are the building blocks of LbL coatings. The process commonly relies on electrostatic interactions and is self-limiting. For example, charge-reversals that occur during the process eliminate the thermodynamic favorability of additional molecules being adsorbed to the growing film.

Spray, dip, spin, and flow LbL assembly methods and combinations thereof, are known. In each of these methods, the formulation solution characteristics may be varied to achieve specific growth rates. For example, growth rates can be varied by changing the pH of the solution or the ionic strength of the solution.

The self-limiting nature of LbL assembly enables the deposition of an excess of material to create coatings while accommodating variation in the equipment and process conditions. This leads to extremely good uniformity, the hallmark of LbL coatings, even over very large areas, despite the influence of processing conditions or non uniformities in the apparatus used for the deposition process. Correspondingly the efficiency of the transfer of molecules in solution to the coating can be, and is typically, low. This leads to challenges with wasted materials leading to increased material costs and waste processing.

Scale-up of the LbL process involves increasing the number of bilayers (i.e. coating thickness) and/or increasing the lateral dimensions (i.e. coating area). Previously, challenges have manifested during scale-up of the layer by layer process. Such challenges include nonuniformity, interfacial blending between interfaces of two bilayers or two types of bilayers, increased optical haze, higher variability in growth rates, and increased surface roughness. While some of these defects can occasionally be desirable for certain applications, control over these effects is necessary for reproducible processing over large areas and for achieving high figures of merit for applications. Challenges to scale-up of the LbL process also involve improving material transfer efficiencies and increasing manufacturing throughput, or line speed, while maintaining the uniformity and control of the process.

SUMMARY

In one aspect, the invention provides a method for a rapid and high transfer efficiency deposition process for forming a half bilayer for layer-by-layer assembly, the method comprising: (a) forming a layer of a deposition solution containing a deposition material on a surface with a thickness ($d_{dep}$), wherein $d_{dep}$ is given by:

$$C_s/(C_B \cdot \text{eff}) \geq d_{dep} \geq (C_s/C_B)$$

(b) maintaining a minimum wait time ($t_{dep\text{-}min}$) of contact between the deposition solution and the surface, wherein during $t_{dep\text{-}min}$ the half bilayer is formed, and wherein $t_{dep\text{-}min}$ is:

$$t_{dep\text{-}min} \geq C_s^2/(C_B^2 \cdot D)$$

wherein: $C_s$ is the desired 2-dimensional concentration of deposition material on the surface; $C_B$ is the bulk concentration of deposition material in the deposition solution; $d_{dep}$ is the thickness of the layer of deposition solution, or deposition layer, on the surface; eff is the transfer efficiency of deposition material and is greater than 0.03; and D is the diffusion coefficient of the deposition material in the deposition solution; $t_{dep\text{-}min}$ is the minimum wait time and is less than 10 seconds; and the thickness of the formed half bilayer is less than or equal to the thickness of a monolayer of the deposition material.

In embodiments:

the surface is selected from a substrate surface, a residual rinse layer, or a portion of a layer-by-layer film.

the method comprises applying a rinse solution to the surface to remove excess deposition solution, wherein the applying forms a residual rinse layer comprising residual rinse solution.

the method comprises removing residual rinse solution remaining on the surface.

the method comprises repeating steps (a) and (b) to form a layer by layer assembled film comprising a plurality of half bilayers.

$C_s$ is the surface concentration based on randomly packed spheres where the areal coverage is between 0.45 and 0.54. Although such values are provided in the context of nanoparticles, they are not intended to be limiting, and non-particulate or non-spherical particle materials (e.g. small molecules, polyelectrolytes, etc.) may also be used in the methods and apparatus described herein.

the residual rinse solution remaining on the surface is less than 5 microns but greater than 500 nm in thickness.

the layer of deposition solution is applied via a spray process.

the deposition material comprises nanoparticles and wherein $C_B$ of the nanoparticles is between $4\times10^{19}/cm^3$ and $2\times10^{13}/cm^3$. Although such values are provided in the context of nanoparticles, they are not intended to be limiting, and non-particulate or non-spherical particle materials (e.g. small molecules, polyelectrolytes, etc.) may also be used in the methods and apparatus described herein.

the formed half bilayer exhibits less than 3% variation in thickness or optical property over an area of at least 16 square inches.

In another aspect, the invention provides a method for depositing a layer by layer assembled film at high transfer efficiency, eff, and rapid deposition-rinse-deposition cycle times, $t_{dep}$, comprising the deposition of at least a half bilayer using a process as described herein.

In another aspect, the invention provides a method for depositing a half bilayer, the method comprising: (a) applying a first deposition solution comprising a first deposition material and a first solvent to form a deposition layer on a surface, such that there is sufficient material in the deposition layer to form a self-limited half bilayer; (b) allowing a coating layer of the first deposition material to bind to, and to form on, the surface by allowing the deposition layer to contact the surface for a period of time $t_{dep}$, wherein the formed coating layer is a half bilayer, and wherein the concentration of first deposition material in the deposition layer is decreased as first deposition material binds to the surface; (c) applying a rinse solution to the deposition layer to form a residual rinse layer and allowing unbound first deposition material to diffuse away from the coating layer for a period of time $t_{rinse}$, wherein the concentration of unbound first deposition material near the coating layer decreases during $t_{rinse}$; and (d) optionally reducing the thickness of the residual rinse layer.

In embodiments:

steps (c) and (d) are repeated z times to further remove unbound deposition material, wherein each allowing (i.e., each repeat allows) unbound first deposition material to diffuse away from the coating layer is independently carried out for a period of time $t_{rinse_z}$, where z is an integer index.

the method is repeated a plurality of times to create a plurality of stacked half bilayers, and the method is for forming a layer-by-layer assembled film.

the layer-by-layer assembled film is formed with high transfer efficiency (eff) and rapid deposition-rinse-deposition cycle times.

the surface is either a substrate, residual rinse layer or a portion of the layer by layer film.

the layer by layer assembled film is created from multiple half bilayers.

the thickness of the residual rinse layer is decreased by application of air knife, squeegee, nip roller, heat, vacuum, translational movement, ultrasonic energy, magnetic field, electric field or a combination thereof.

wherein eff is >0.03.

wherein $t_{dep}+t_{rinse}<10$ seconds.

the reducing of the thickness of the residual rinse layer is enhanced by addition of one or more additives to the rinse solution.

In another aspect, the invention provides a method for forming a nanoparticle solution for use in forming bilayers via the LbL process, the method comprising combining water, a nanoparticle, and a component selected from salts, pH modifying agents, or combination thereof, in concentrations such that the Debye layer thickness is between 1 and 10 nanometers. Debye thickness can be calculated or measured by stability experiments looking for flocculation.

In embodiments:

the salt is present in a salt concentration determined by a process comprising: (a) preparing a series of coatings, wherein each coating in the series of coatings is prepared in a LbL fashion using alternating depositions of a unique nanoparticle solution and a standard polyelectrolyte solution, and comprises 1 or more bilayers disposed on a substrate, provided that: (i) each unique nanoparticle solution is selected from a series of nanoparticle solutions and comprises a fixed concentration of nanoparticle and a unique concentration of a salt; (ii) the fixed concentration of nanoparticles is sufficient to achieve a desired Cs (e.g., a saturated area of the substrate); and (iii) sufficient time is given between bilayer deposition such that saturation of the surface is complete; (b) measuring (i.e., physically or optically) the thickness of each of the coatings prepared in (a) and determining the average bilayer thicknesses for each coating; (c) identifying from the thicknesses measured in (b) a salt concentration range where bilayer thickness changes by less than 1% (or, in embodiments, less than 0.5, 0.25, or 0.05%) per one millimolar change salt concentration; and (d) selecting the salt concentration from within the identified salt concentration range, the series of coating comprises 3 (or, in embodiments, 5, 10, 15) or more coatings.

the selected salt concentration is the midpoint of the identified salt concentration range.

the pH of the solution is adjusted by adding a pH-modifying agent such that the zeta potential is relatively invariant with changes in pH (e.g., zeta potential changes by less than 5 mV with a change in pH of 1.0).

In another aspect, the invention provides a method for forming a coating comprising a plurality of bilayers on a surface, the method comprising: (a) applying a nanoparticle solution prepared according to the method of claim 1 to the surface, applying a first rinse solution to the surface, applying a polyelectrolyte solution comprising a polyelectrolyte to the surface, and applying a second rinse solution to the surface to form a bilayer; (b) repeating (a) a plurality of times to form the plurality of bilayers, wherein the thickness of each bilayer is between 68-82% of the average diameter of the nanoparticles.

In embodiments:

the polyelectrolyte solution comprises an added salt.

the first and second rinse solutions are the same.

the nanoparticle solution, polyelectrolyte solution, and first and second rinse solutions are applied to the surface in the form of a spray.

the pH, or the salt concentration, or the combination of pH and salt concentration of the nanoparticle solution is selected such that the nanoparticles form a close packing in the plurality of bilayers.

the close packing is random close packing.

the random close packing leads to an average 3-D volume fraction of voids between 0.25 and 0.48 for a half bilayer of spherical nanoparticles.

the method further comprises allowing sufficient time to elapse after applying the nanoparticle solution and before applying the first rinse solution such that the nanoparticles form a close packed arrangement on at least a portion of the surface.

the method further comprises removing excess rinse solution and solvent after applying the first rinse solution.

the method further comprises removing excess rinse solution and solvent after applying the second rinse solution.

the nanoparticles comprise a first binding group and the polyelectrolyte comprises a second binding group, and wherein the first and second binding groups form a complementary binding pair.

The invention further includes a coating prepared according to the above methods.

The invention further includes an article comprising a coating of above disposed on a substrate.

In another aspect, the invention provides a multilayer photonic structure comprising a plurality of bilayers, wherein each bilayer comprises a layer of a polyelectrolyte and layer of a nanoparticle, wherein: (a) at least a portion of the layers of the nanoparticle comprise the nanoparticle arranged in a random close packed monolayer; (b) the multilayer structure is porous and comprises a surface with a surface area greater than 9 $in^2$; and (c) the plurality of bilayers is arranged to create optical interference effects in wavelengths in the range 200-2500 nm.

In embodiments:

the optical interference effects are selected from anti-reflection and selective reflection.

the plurality of bilayers are arranged into one or more quarter wavelength thickness low index layers and one or more quarter wavelength thickness high index layers, wherein the wavelength of interest (lambda 0) is between 200-1500 nm.

the total number of low index layers and high index layers is odd (e.g., in embodiments, 3, 5, 7, 9, 11, 13, or 15).

the difference in refractive index between the low index layers and the high index layers is greater than 0.4.

the plurality of bilayers is disposed on a substrate.

the substrate comprises a mechanism for removing the multilayer photonic structure from the substrate.

the plurality of bilayers is free standing.

the pores are filled with air, an inert gas, a solid material, or a liquid.

the refractive index of the multilayer photonic structure is n1 when the pores are filled with air and n2 when the pores are filled with a substance other than air.

In another aspect, the invention provides a method for forming the multilayer photonic structure as above, the method comprising depositing the plurality of bilayers on a substrate in an LbL fashion.

In embodiments, the method comprises exposing the multilayer photonic structure to a liquid material such that the liquid material is imbibed into the pores, wherein the liquid material is capable of crosslinking upon the application of a crosslinking stimulus (e.g., heat or electromagnetic radiation).

The invention further includes an article comprising the multilayer photonic structure as above, disposed on a substrate.

In another aspect, the invention provides an apparatus for forming a coating on a substrate surface, the apparatus comprising: (a) a plurality of nozzles comprising: (i) a plurality of first deposition nozzles configured to spray a first deposition solution toward a deposition region on the substrate surface; (ii) a plurality of second deposition nozzles configured to spray a second deposition solution toward the deposition region on the substrate surface; (iii) a plurality of rinse nozzles configured to spray a rinse solution toward the substrate; (b) a substrate handling system configured to position the substrate in one or more application positions opposite the plurality of nozzles (e.g., in embodiments, rollers, roll-to-roll web handling, air-sled, robotic arm actuated in a linear fashion, material handling actuators to translate the substrate, etc.); and (c) a solution removal device (e.g., in embodiments, a squeegee, squeegee roll, vacuum bar or air knife or the contact rollers) configured for decreasing a liquid layer thickness on the surface after spraying of solution by the plurality of nozzles onto the surface.

In embodiments:

the deposition nozzles are configured to deliver a deposition layer thickness of 1-20 μm.

the substrate handling system comprises one or more contact rollers configured to contact a deposition side of the substrate after deposition of solution by at least a portion of the plurality of nozzles.

the one or more contact rollers are configured to position the substrate for solution application by the deposition and rinse nozzles.

at least one of the one or more contact rollers is in close proximity (e.g., less than 12, 10, or 5 inches away) to the deposition region of the substrate.

at least one of the one or more contact rollers is configured to contact the substrate and decrease the thickness or the variation in thickness of deposition solution or rinse solution on the surface.

the method further comprises a mechanism to remove material from the contact roller (e.g., a wiper or doctor blade).

at least one of the one or more contact rollers has a surface finish with RA (arithmetic mean) surface roughness of less than 32 microinches (or, in embodiments, less than 12, 6, or 2 microinches).

the solution removal device comprises one of the one or more contact rollers.

the method further comprises a collection system positioned to collect liquid waste (which can be waste deposition solution, rinse solution, or both) removed from the substrate.

the liquid layer thickness is selected from a deposition layer thickness and a residual rinse layer thickness, or a combination thereof.

the first and second deposition nozzles are configured to deposit first and second deposition solution at a flow rate corresponding to less than ten (or, in embodiments, less than 1, 0.1, 0.01) gallons per square meter of the substrate per hour.

the solution removal device is a vacuum attachment and is disposed in close (e.g., less than 15, 10, 5 mils) proximity to at least one of the one or more contact rollers.

the solution removal device is configured to remove from the substrate by convection more than 50% of the rinse solution applied by the plurality of rinse nozzles.

the method further comprises a ventilation system (e.g., a vacuum or a system to create an air flow to remove atomized droplets, plus a ventilation box) configured to ventilate at least a portion of atmosphere near the nozzles.

the ventilation system is configured to confine aerosolized deposition solution to a deposition region.

the plurality of first deposition nozzles and the plurality of second deposition nozzles are the same nozzles.

the plurality of first deposition nozzles are different from the plurality of second deposition nozzles.

the plurality of first deposition nozzles and the plurality of second deposition nozzles are configured to overlap spray patterns in the deposition region of the substrate.

the method further comprises an oscillator configured to oscillate at least a portion of the plurality of nozzles about an axis.

the method further comprises one or more contact rollers configured to contact a non-deposition side of the substrate.

the method further comprises a plurality of treating nozzles for treating a residual rinse layer or a deposition layer.

the plurality of treating nozzles are configured to apply a surface tension-lowering material (e.g., a solvent or surfactant) to the residual rinse layer or to the deposition solution.

the method further comprises a specular reflectance measurement device configured to measure thickness of the residual rinse layer.

wherein the substrate handling system provides for translating a rigid substrate sequentially past at least a plurality of nozzles for applying deposition solution and at least a plurality of nozzles for applying rinse solution.

wherein the substrate is oriented vertically.

wherein the substrate is oriented horizontally.

wherein the solutions are in contact with the underside of the horizontally oriented substrate.

The invention further includes a deposition module, comprising the apparatus as above.

The invention further includes a system comprising a plurality of deposition modules as above.

In some aspects, then, there is provided herein a method for forming a coating. The method comprises: (a) depositing onto a surface, in a layer-by-layer manner, a first deposition solution and a second deposition solution to form a bilayer, wherein the first deposition solution comprises nanoparticles having a first binding group and the second deposition solution comprises a polyelectrolyte having a second binding group, and wherein the first binding group and the second binding group form a complementary binding pair; (b) applying a rinse solution to remove excess nanoparticles after depositing the first deposition solution, and applying a rinse solution to remove excess polyelectrolyte after depositing the second deposition solution; (c) repeating (a) and (b) a plurality of times to form a plurality of bilayers, wherein the temperature of the coating is maintained below an upper temperature limit and above a lower temperate limit at least through formation of the plurality of bilayers.

In another aspect, the disclosure provides a method for forming a coating comprising: (a) forming a first bilayer by spray application in a layer-by-layer manner a pair of materials having complementary binding groups; (b) forming a second bilayer over the first bilayer by spray application in a layer-by-layer manner the pair of materials having complementary binding groups, wherein the temperature of the first bilayer is maintained below the calcination temperature of the first bilayer prior to and during formation of the second bilayer.

In another aspect, there is provide a method for forming a coating, comprising: (a) depositing a first coating solution comprising nanoparticles, a solvent, and a first salt onto a surface, and allowing sufficient time to elapse such that the nanoparticles form a close packed arrangement on at least a portion of the surface; (b) applying a rinse solution onto the layer formed in (a); (c) removing excess rinse solution and solvent; and (d) depositing a second coating solution comprising a polyelectrolyte, a solvent and a second salt onto the close packed arrangement of nanoparticles to form a first bilayer, wherein the nanoparticles comprise a first binding group and the polyelectrolyte comprises a second binding group, and wherein the first and second binding groups form a complementary binding pair. In some aspects, the method further comprises: (a) depositing additional first coating solution onto the first bilayer to form a close packed arrangement of nanoparticles on the first bilayer; (b) depositing additional second coating solution onto the close packed arrangement of nanoparticles from (a) to form a second bilayer on the first bilayer.

In yet another aspect, the disclosure provides a coating on a surface, the coating comprising a plurality of bilayers, wherein each bilayer comprises nanoparticles and a polyelectrolyte and is defined by a thickness in the range 65-87% or 68-82% of the average diameter of the nanoparticle present in the bilayer.

In yet another aspect, the disclosure provides a coating on a surface, the coating comprising a plurality of bilayers, wherein: the coating is porous; a portion of the bilayers comprises a tightly packed monolayer of nanoparticles and a polyelectrolyte; and the nanoparticles comprise a first binding group and the polyelectrolyte comprises a second binding group, wherein the first and second binding group form a complementary binding pair.

In yet another aspect, the disclosure provides a multilayer photonic structure comprising a plurality of bilayers, wherein: (a) a portion of the bilayers comprises a polymer and a tightly packed monolayer of nanoparticles; (b) the multilayer structure is porous; and (c) the bilayers are arranged to create optical interference effects.

In yet another aspect, the disclosure provides method for forming a multilayer photonic structure, the method comprising: (a) depositing a bilayer on, wherein the bilayer comprises a polyelectrolyte and a monolayer of nanoparticles, (b) repeating (a) a plurality of times to form a plurality of bilayers stacked on the substrate, wherein the plurality of bilayers forms a porous multilayer film.

In yet another aspect, the disclosure provides a method for controlling a layer-by-layer deposition process, the method comprising: (a) applying a first deposition solution comprising a first deposition material and a first solvent to form a deposition layer on a surface; (c) allowing a coating layer of the first deposition material to form on the surface by allowing the deposition layer to contact the surface for a period of time $t_{dep}$, wherein the concentration of first deposition material in the deposition layer is decreased as first deposition material binds to the surface; (e) applying a rinse solution to the deposition layer, wherein the rinse solution dilutes the deposition layer to form a residual rinse layer; (g) applying a second deposition solution comprising a second deposition material and a second solvent to form a deposition layer on the surface, wherein the second solvent is optionally the same as the first solvent; (i) allowing formation of a coating layer of the second deposition material bonded to the coating layer of the first deposition material by allowing the deposition layer to contact the surface for a period of time $t_{dep2}$, wherein the concentration of second deposition material in the deposition layer is decreased as second deposition material binds to the surface; and (k) applying a rinse solution to the deposition layer, wherein the rinse solution dilutes the deposition layer to form a residual rinse layer. After steps (a) and (g), the method may optionally further include one or both of steps (b) and (h), which comprise smoothing or spreading the respective deposition layer. After steps (c) and (i), the method may optionally further include one or both of steps (d) and (j), which comprise reducing the thickness of the respective deposition layer. After steps (e) and (j), the method may optionally further include one or both of steps (f) and (l), which comprise reducing the thickness of the respective residual rinse layer. The method may further optionally comprise repeating steps (a)-(l) one or more times to form a multi-bilayered structure. The method may further optionally comprise additional repetitions of steps (e-f) and (k-l) as needed. For example in a two-stage rinse setup, steps (e) and (f) may be repeated twice prior to progressing to step (g).

In yet another aspect, the disclosure provides a method for forming a multilayered film, the method comprising: (a) applying a first deposition solution to a substrate to form a first deposition layer, wherein the first deposition layer comprises solvent and a first deposition material; (c) applying a rinse solution to the first deposition layer to form a first residual rinse layer; (e) applying a second deposition solution to form a second deposition layer, wherein the second deposition layer comprises solvent and a second deposition material; and (g) applying a rinse solution to the second deposition layer to form a second residual rinse layer; wherein the first and second deposition materials have complimentary bonding units. The method may further optionally comprise step (b) after step (a), comprising reducing the average diffusion time of the first deposition material in the first deposition layer. The method may further optionally comprise step (d) after step (c), comprising reducing the thickness of the first residual rinse layer, provided that at least one of (b) and (d) is carried out. The method may further optionally comprise step (f) after step (e), comprising reducing the average diffusion time of the second deposition material in the second deposition layer. The method may further optionally comprise step (h) after step (g), comprising reducing the thickness of the second residual rinse layer provided that at least one of (f) and (h) is carried out.

In yet another aspect, the disclosure provides an apparatus for forming a coating on a substrate, the apparatus comprising: a plurality of deposition nozzles for the spray application of a first deposition solution; a plurality of deposition nozzles for the spray application of a second deposition solution; a plurality of nozzles for the spray application of rinse solution; means for handling the substrate; and means for decreasing a deposition layer thickness and/or a residual rinse layer thickness. The apparatus may further comprise one or more of the following optional components: means for ventilating the apparatus; one or more contact rollers configured to contact a deposition side of the substrate; means for removing or recycling liquid waste; means for applying a vacuum to effect the removal of excess solution; and a plurality of nozzles for treating residual rinse or deposition solution.

In yet another aspect, the disclosure provides a method for a rapid and high transfer efficiency deposition process for forming a half bilayer comprising a desired 2-dimensional concentration of deposition material on the surface ($C_s$) wherein the thickness of the half bilayer is less than or equal to the thickness of a monolayer of the deposition material, the method comprising: (a) applying a deposition solution to a surface to form a deposition layer directly or indirectly disposed on the surface, and optionally thinning the deposition layer, wherein: the deposition layer has thickness $d_{dep}$; the deposition solution comprises a solvent and a deposition material, wherein the concentration of deposition material in the deposition layer is $C_B$; the deposition material has diffusion coefficient D in the deposition layer; and eff is the material transfer efficiency of deposition material, a positive number less than 1.0 and greater than 0.03; and (b) allowing a period of time $t_{dep}$ to elapse such that $t_{dep}$ is greater than or equal to ($C_s^2$;/[$C_B^2$×D]). The method may further comprise: (c) applying a rinse solution to the deposition layer to form a residual rinse layer and allowing unbound first deposition material to diffuse away from the surface for a period of time $t_{rinse}$, wherein the concentration of unbound first deposition material near the surface decreases; and d) reducing the residual rinse layer thickness. The method may further comprise: the repetition of steps (a-d), using a complementary deposition solution, with its own $C_s$ $C_B$, eff, D, and $t_{dep}$) to form a complementary half bilayer, the result of which will be a bilayer. The method may further comprise the repetition of multiple complementary bilayers for the formation of a film.

These and other aspects will be apparent from the disclosure provided herein below, including the examples, claims, and figures.

BRIEF DESCRIPTION OF THE DRAWINGS

FIG. 2*a* provides a schematic representation of a pair of adjacent nanoparticle monolayers with a layer of polyelectrolyte disposed there between.

DEFINITIONS

Figure 1A:
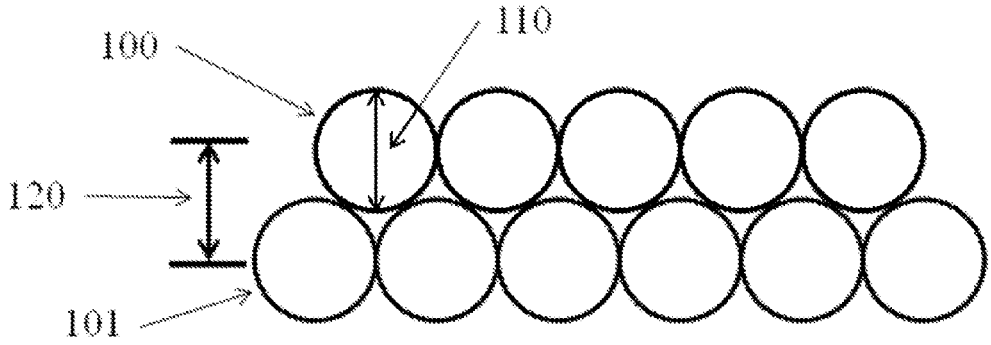
FIG. 1*a* provides a schematic representation of two adjacent tightly packed monolayers.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are described herein.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

The term "typically" is used to indicate common practices of the invention. The term indicates that such disclosure is exemplary, although (unless otherwise indicated) not necessary, for the materials and methods of the invention. Thus, the term "typically" should be interpreted as "typically, although not necessarily." Similarly, the term "optionally," as in a material or component that is optionally present, indicates that the invention includes instances wherein the material or component is present, and also includes instances wherein the material or component is not present.

As used herein and unless indicated otherwise, the term "substrate surface" (or sometimes simply "surface"), includes the surface of a substrate itself as well as the surface of any coatings deposited on the substrate (including a portion of a layer-by-layer coating), as well as a liquid layer present on a surface. Thus, for example, when a material is deposited on a substrate surface, the material may be deposited directly onto the surface of the substrate itself, or the material may be deposited onto the surface of a coating disposed on the substrate.

Throughout this disclosure, coatings disposed on a substrate and containing multiple layers are described. In such descriptions, a first layer is described as "above" a second layer if the second layer is closer to the substrate compared with the first layer. That is, the second layer underlays the first layer. Similarly, a first layer is described as "below" a second layer if the first layer is closer to the substrate. Where a coating is not disposed on a substrate (i.e., the coating is free-standing), a first layer is "below" a second layer if the first layer was formed prior to the second layer during formation of the coating.

As used herein and unless otherwise specified, the terms "coating" and "film" are used interchangeably.

Definitions of other terms and concepts appear throughout the detailed description below.

DETAILED DESCRIPTION

Coatings—Composition and Physical Properties

The present disclosure provides methods, materials, and apparatuses for preparing coatings, as well as the coatings and coated objects thus prepared. Examples of coatings as well as their physical properties and uses are provided in detail below.

Monolayer Geometry and Sphere Packing

In some embodiments, the LbL deposition methods described herein result in bilayers, wherein each bilayer contains a tightly packed layer of nanoparticles as well as a polyelectrolyte. In some embodiments, the LbL deposition methods described herein are spray LbL deposition methods. Although in many instances spray LbL deposition is described herein, such description is used only for ease of description and is not meant to limit the disclosure to spray methods. Unless indicated otherwise or obvious from the context, the disclosure is meant to include other LbL methods (e.g. dip, etc.).

As used herein, by a "tightly packed" layer of nanoparticles is meant that the nanoparticles form a substantially homogeneous monolayer with a high packing density of nanoparticles. By high packing density, this includes packing arrangements that include hexagonal close packed, random close packed, and other close packings known in the art. In some embodiments the three dimensional density of monodisperse nanoparticle is greater than 50%, or greater than 55% or greater than 60%. In some embodiments the three dimensional density of monodisperse nanoparticle is between 50-64%, or 55-64, or 60-64%

In some embodiments, the nanoparticles are nanospheres. In the context of nanospheres, the monolayer may have any of a variety of packing geometries, including a packing geometry selected from square (i.e. each sphere has four immediate neighbor spheres) and hexagonal (i.e. each sphere has six immediate neighbor spheres). In any such packing geometry, a monolayer comprises nanoparticles and void spaces between the nanoparticles, and there is a theoretical maximum packing density that occurs for a perfect hexagonal structure without spaces between particles.

In the context of hexagonally packed nanospheres, then, a "tightly packed layer" is one that has a high packing density of nanospheres compared with the theoretical maximum. In some embodiments, for example, the tightly packed layer has a packing density that is greater than 50, 75, 80, 90, 95, or 99% of the theoretical maximum. As described in more detail below, such tightly packed layers may occur with minimal or no defects over a wide area, such as an area of greater than 1, 10, or 100 $\mu m^2$.

Generally, throughout this specification, references to tightly packed nanoparticles are made in the context of hexagonal packing of nanospheres. However, such references are intended to be exemplary for ease of understanding the disclosure, and are not meant to be limiting. As used herein, the term "nanospheres" refers to nanoparticles that are nominally spherical in shape but are not necessarily perfectly spherical. Thus, "nanospheres" is meant to include ovals, ellipsoids, rough spheres and other three dimensionally round shapes.

In some embodiments, for any two adjacent bilayers, the tightly packed layers of nanoparticles are arranged in a manner that maximizes three-dimensional packing density. In some embodiments adjacent layers of nanoparticles are offset such that the nanoparticles of one layer sit recessed in the crevices of the adjacent layer. As used herein, the term "crevice" refers to the spaces between nanoparticles in a monolayer.

For example, where the monolayers of nanoparticles that form the bilayers are arranged in a hexagonal geometry, the three-dimensional packing geometry of the nanoparticles of adjacent bilayers may be selected from any of the close-packing geometries, including cubic close packing and face centered cubic. In such geometries, each nanoparticle (other than those located on edges) has 12 immediate neighbor spheres (six in the same monolayer, and three in each of the adjacent monolayers). Also for example, where the monolayers of nanoparticles are arranged in a square geometry, adjacent layers are offset such that each nanoparticle (other than those located on edges) has 12 immediate neighbor spheres (four in the same monolayer, and four in each of the adjacent monolayers). It will be appreciated that these values apply only to nanoparticles in internal layers (i.e. layers having two adjacent layers). For the uppermost and lowermost bilayers, the number of neighboring spheres will be nine (for hexagonal packing) or eight (for square packing)

Bilayer Thickness and Film Growth Rate

Because of the tightly packed geometry described above, in some embodiments the thickness of each bilayer is less than the average diameter of the nanoparticles that form the bilayers. As used herein, the "thickness" of a bilayer refers to the average distance between the center of the nanoparticles that form the bilayer and the center of the nanoparticles that form an adjacent bilayer. With this definition, the following will be appreciated. First, the "center" of the nanoparticles of a given layer refers to a hypothetical plane intersecting the nanoparticles in such a way that minimizes the summation of the perpendicular distances between the plane and the center of each individual nanoparticle. Second, this definition is only relevant for a coating having more than one bilayer, and for a coating having "n" bilayers, only n−1 thicknesses are definable. Third, each bilayer having two adjacent bilayers (i.e. one above and one below) can have two thicknesses. It is appreciated that with this discussion of bilayer thicknesses, that the bilayer comprises a nanoparticle which primarily defines the geometric thickness of the bilayer and further comprises a material that adds negligible thickness. For example, a polymer polyelectrolyte, defined below, may add 0.5 nm of thickness to the bilayers which may fall within experimental measurement in bilayer thickness. Accordingly, where an average thickness is calculated for a plurality of bilayers, only one thickness is assigned to each bilayer, and the method for calculating the bilayer thickness will be consistent across the plurality of bilayers. For bilayers that comprise two materials, such as two types of nanoparticles, that provide substantive thickness, then the aforementioned discussion of bilayers will be applicable to neighboring monolayers.

An "average thickness" of bilayers that form a coating prepared according to the methods herein can be calculated by dividing the total thickness of the coating by the number of bilayers present. For example, a coating having a thickness of 500 nm and containing 10 bilayers has an average bilayer thickness of 50 nm.

The theoretical lower limit for bilayer thickness for hexagonally close packed layers is 81% of the diameter of the nanoparticles. This lower limit assumes that the nanoparticles are completely rigid spheres of uniform diameter, and that the bilayers assume the tightly packed geometries described above (i.e. where the nanoparticles of one layer sit within the crevices of each adjacent layer). It will be appreciated that the theoretical average thickness of bilayers of a coating prepared from tightly packed monolayers, as measured in the above-mentioned manner, will be greater than 81% and asymptotically approach 81% in the limit of an infinite number of bilayers. In practice, bilayer thicknesses that fall below the theoretical lower limit may indicate that the monolayers of nanoparticles are tightly packed in different manners (i.e. random close packing, a jammed state or that. the crevices between nanoparticles are larger than for a tightly packed monolayer, and adjacent layers can sit lower within the crevices). Bilayer thicknesses that are larger than the theoretical lower limit may indicate that the monolayers have defects (e.g. clusters or aggregates of nanoparticles that disrupt the tight packing geometry), or that the spheres of one layer are not sitting in the crevices of a lower layer.

In some embodiments, the bilayers prepared according to the methods described herein have an average thickness within the range 50-150%, or 60-100, or 75-90, or 78-85, or 80-82% of the average diameter of the nanoparticles. In some embodiments, the bilayers have an average thickness of greater than 50, 60, 70, 75, 78, or 80% of the average diameter of the nanoparticles. In some embodiments, the bilayers have an average thickness of less than 150, 120, 100, 90, 85, or 82% of the average diameter of the nanoparticles. In some embodiments, the bilayers have an average thickness of 81% of the average diameter of the nanoparticles. In some embodiments, the bilayers will have an average thickness of 72% of the average diameter of nanoparticles. Without wishing to be bound by theory it is believed that this lower average thickness arises from a random close packing, in which the volumetric packing density is lower than that of hexagonally close packed geometry. Further without wishing to be bound by theory it is believed that nanoparticles with different stabilizing counterions may make certain films more susceptible to reorientation on the surface during the bilayer assembly process. For example, a stabilizing counterion, that enables a stronger binding between the surface and the nanoparticle, may prevent reorganization of the particles, leading to a random close packed or "jammed" packing, whereas counterions that provide weaker binding between the surface and the nanoparticle, may allow the nanoparticles to "roll around" on the surface and create an even more tightly packed surface. In some embodiments, a monolayer of random close packed particles can be determined based on the areal coverage of the two-dimensional projection of the particles on the surface. In some embodiments, this areal coverage is between 0.45 and 0.54.

It will be appreciated that the bilayer thickness not only influences physical and optical properties of the resulting coating, it also influences the growth rate of the coating during preparation. Thus, one method for determining and tracking bilayer thickness is to monitor the thickness of a film during the deposition process.

It will also be appreciated that the above-described analysis assumes that all nanoparticles have the same geometric dimension and shape. In practice there is expected to be some natural variation in nanoparticle diameter and shape leading to deviations in thickness and packing from the idealized case. The expected deviations in packing and thicknesses can be accounted for (both experimentally and computationally) by those versed in the art.

Polyelectrolyte Considerations

As used herein, reference to a "polyelectrolyte" intends a polymer material that contains or can be made to contain (e.g., by appropriately adjusting the pH of a solution containing the polyelectrolyte) a plurality of electrostatic charges. Use of such term is not meant to imply that the nanoparticles and other materials used herein do not contain a plurality of electrostatic charges (and, therefore, could not also be appropriate referred to as "polyelectrolytes").

In some embodiments, the polyelectrolyte in the bilayers described herein is disposed in the interstitial spaces between nanoparticles. It will be appreciated, however, that substantial amounts of polyelectrolyte disposed directly between nanoparticles may interfere with contact of the nanoparticles, thereby causing the packing density of the nanoparticles to depart from the theoretical maximum (i.e. the value obtained assuming hard spheres and tight packing). In other words, the presence of polyelectrolyte between nanoparticles in a monolayer may increase the in-plane center-to-center distance of the nanoparticles. In some embodiments, this effect is desired as it allows for control over the thickness of the bilayers (e.g. an increase in in-plane center-to-center distance results in a decrease in bilayer thickness, as compared in FIG. 1*a* and FIG. 1*b*), or control over physical properties like porosity and optical properties like refractive index. In other embodiments, however, it is desired to eliminate or minimize the amount of deviation from maximum packing density, as maximum packing density allows bilayer thickness substantially equal to the theoretical value for tightly packed, uniform hard spheres.

Accordingly, in some embodiments, the amount of polyelectrolyte that is present between nanoparticles of any given monolayer is sufficiently small (and may be zero) such that the nanoparticles of that monolayer are able to form a tightly packed arrangement within experimental error. By "within experimental error" is meant that, as observed in experiments, the bilayer thickness is equivalent to the theoretical limit (i.e. assuming tight packing of the nanoparticles) or varies from the theoretical limit by less than 10%, or less than 1%, or less than 0.1%, or less than 0.01%, or less than 0.001%. Alternatively or in addition, "within experimental error" means that, as observed in experiments, the nanoparticles of a given monolayer have an average center-to-center distance that is equivalent to the theoretical limit (i.e. assuming tight packing of the nanoparticles) or varies from the theoretical limit by less than 10%, or less than 1%, or less than 0.1%, or less than 0.01%, or less than 0.001%. Experimental methods for determining bilayer thickness and center-to-center nanoparticle distances are described herein, and include methods such as optical methods (e.g. ellipsometry) and electrical/physical methods (e.g. TEM or AFM or profilometry).

In some embodiments, the polyelectrolyte is present between the nanoparticles of one bilayer and the nanoparticles of another bilayer. The presence of significant amounts of polyelectrolyte between bilayers (i.e. between the nanoparticles of one monolayer and the nanoparticles of an adjacent monolayer) may increase the out-of-plane distance between the nanoparticles, thereby increasing bilayer thickness in the coating. Such an effect can be desirable for some embodiments for a variety of reasons. For example, the effect allows control over bilayer thicknesses that are greater than the theoretical minimum (i.e. assuming hard spheres that are tightly packed), and also allows for control over the optical properties of the coating.

Figure 2A:
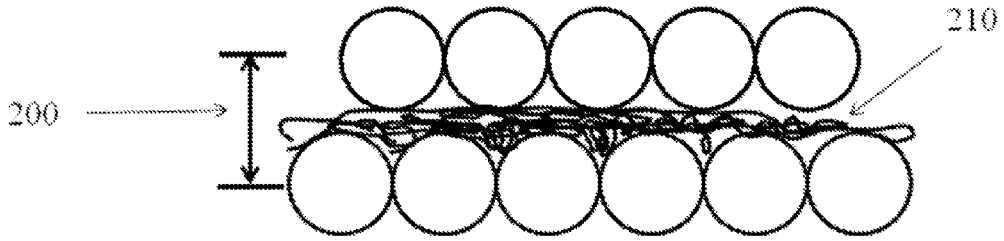

If a sufficiently large amount of polyelectrolyte is present between monolayers of nanoparticles, the nanoparticles of adjacent bilayers do not overlap at all, and the thickness of the bilayers is greater than the diameter of the nanoparticles. A schematic example of such an embodiment is shown in FIG. 2*a*. In FIG. 2*a* a large amount of polyelectrolyte 210 is disposed between the two monolayers, such that the center-to-center distance between the monolayers, 200, is increased. In such an embodiment, out-of-plane center-to-center distances between nanoparticles of adjacent bilayers are controllable by increasing the thickness of the polyelectrolyte layer.

Nanoparticle Considerations

In some embodiments, bilayers containing nanoparticles of varying diameter are used. For example, in some coatings the nanoparticles within any particular monolayer are of a substantially consistent diameter (e.g. within 25% of the average, or within 20% of the average, or within 15% of the average, or within 10% of the average, or within 5% of the average, or within 1% of the average), but the diameter of the nanoparticles of one bilayer may be substantially different from the diameter of the nanoparticles of adjacent layers. Such an embodiment is exemplified by the schematic shown in FIG. 2*b*. In some embodiments, layers of nanoparticles having a relatively small average diameter are used along with layers of nanoparticles having a relatively large average diameter. The layers of smaller nanoparticles may be used, for example, to form a more gradual transition from a section of the coating having one refractive index to a section of the film having a different refractive index.

Figure 2B:
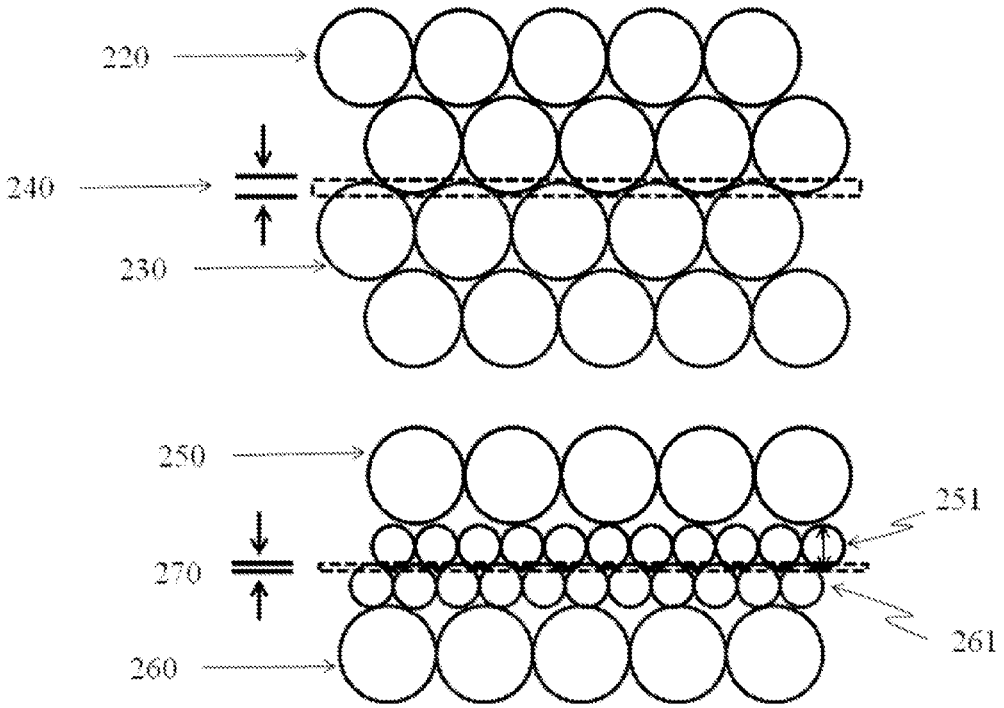
FIG. 2*b* provides two schematic representations of an interface between nanoparticles of two different materials (wherein the different materials are indicated by the presence and absence of shading). In the upper representation, uniform nanoparticles are used through the coating. In the lower representation, nanoparticles of two different diameters are used to prepare the coating.

In some embodiments, nanoparticles of different diameters may be used in a single coating. For example, two batches of nanoparticles having average diameters $d_{np1}$ and $d_{np2}$ may be used to prepare a coating. In some embodiments, the two batches of nanoparticles may be applied together in a single deposition solution, such that each bilayer comprises both diameters of nanoparticles. Alternatively, the two batches of nanoparticles may be applied in separate deposition solutions, such that each bilayer has nanoparticles of a single diameter, but different bilayers have nanoparticles of different diameter. It will be appreciated that the use of nanoparticles with different diameters may result in thinner interfacial regions. In one extreme case, shown in FIG. 2*b*, the interfacial region 270 is insignificant or nearly nonexistent between bilayers of 251 and 261 compared with the interfacial region 240 between bilayers of 220 and 230. In some embodiments, as shown in FIG. 2*b*, bilayers of 251 are used with 250 and bilayers of 261 are used with 260 to decrease the interfacial thickness 270. Suitable nanoparticle diameters are discussed in more detail below. In some embodiments using nanoparticles of diameter $d_{np1}$ and nanoparticles of diameter $d_{np2}$, $d_{np1}$ is greater than $d_{np2}$ by a factor of about 50%, or by a factor of 100%, or by a factor of 2, 3, 4, 5, or more.

Furthermore, nanoparticles of the same or different compositions may be used in a single coating. For example, two batches of nanoparticles made of any two of the materials described herein below may be used (either in the same bilayer or in separate bilayers) to tune the properties of the coating. Furthermore, nanoparticles that are themselves composed of two or more materials, as described below, may be used. For example, zinc antimonate nanoparticles, made from zinc oxide and antimony oxide, or core-shell particles such as silicon dioxide enrobed with aluminum oxide, can be used. Furthermore, nanoparticles can possess a modified surface with organic or inorganic ligands. For example amino trimethoxypropylsilane functionalized, glycidyl propyl trimethoxysilane functionalized, or other silane functionalized silicon dioxide nanoparticles can be used.

It will be appreciated that the nanoparticles used to form the bilayers of interest may depart from the "ideal" case of perfectly uniform spheres. That is, the nanoparticles will have a size distribution (referred to as polydispersity), and there may be nanoparticles within the sample that deviate from perfect spheres (e.g. having slight protrusions, or being slightly ellipsoidal, etc.). Furthermore, as the methods of the invention are suitable to employ commercially available nanoparticles, such defects and variations may be characterized or uncharacterized (i.e. known or unknown). In some embodiments, significant variation in the uniformity of the nanoparticles employed in the methods of the invention can be detected by variation of the optical properties, physical properties (e.g. film thickness) or other properties of the resulting coatings. The methods described herein are relatively robust and able to tolerate non-uniformity in the nanoparticles. However, when variation is detected in optical or other properties, and where such variation is detrimental to the intended use of the coatings, steps may be taken to obtain and use more uniform nanoparticles (e.g. size separation methods, simply altering the commercial supplier of the nanoparticles).

Furthermore, although the term "nanoparticles" is used throughout this specification in the context of nanospheres, the term is not meant to be limiting to spherical nanoscale materials. As described below in more detail, the term includes nanoparticles such as rods and discs. Where non-spherical nanoparticles are used to make coatings, appropriate considerations, known to practitioners in the art, may be made to take account of the variable packing geometry.

In some embodiments, the nanoparticles of interest contain a plurality of electrostatic charges. In some embodiments, the nanoparticles of interest can be made to contain (e.g. by appropriate adjustment of the pH of a solution containing the nanoparticles) a plurality of electrostatic charges. In some embodiments, the nanoparticles of interest are positively charged. In other embodiments, the nanoparticles of interest are negatively charged. In some embodiments the extent of charge is dependent upon environmental factors such as a solution pH. For example, pH-dependent charges are present for nanoparticles containing organic acid groups (e.g. carboxylic acids) or quaternary amine salts. In other embodiments, the nanoparticles contain permanent or semi-permanent charges (e.g. hard quaternary amines). In some embodiments, the nanoparticles do not contain electrostatic charges but instead contain another binding group such as a hydrogen bond-forming group (either an H-donor group or an H-acceptor group), an antibody or antigen binding group, or the like.

In some embodiments, the nanoparticles of each bilayer form a close packed hexagonal arrangement. It will be appreciated that, in practice, defects in this hexagonal arrangement will exist, but that these defects will represent a small fraction of the area occupied by a bilayer. Such minor defects and irregularities are accounted for herein by the use of the term "substantially" when referring to a close packed arrangement (i.e., a "substantially close packed arrangement"). Unless otherwise indicated, omission of the term "substantially" is not meant to imply a perfect close packed arrangement containing no defects or irregularities. In some embodiments, the in-plane close packed structure is maintained even when the nanoparticle monolayer of one bilayer is not tightly packed with the nanoparticle monolayers of adjacent bilayers. For example, where sufficiently thick layers of polyelectrolyte are present, the nanoparticles of one monolayer cannot sit in the crevices of adjacent monolayers. In such embodiments, the out-of-plane center-to-center distances between nanoparticles are greater than the nanoparticle diameter (e.g. greater by the thickness of the polyelectrolyte layer), but the in-plane center-to-center distances remain substantially similar to the nanoparticle diameter.

Discrete Nanoparticles

In some embodiments, the coatings contain tightly packed arrangements of nanoparticles, wherein the nanoparticles are discrete. By "discrete" is meant that the nanoparticles are not physically or chemically interconnected, such as would be the case for arrangements of nanoparticles that are modified via sintering, hydrothermal treatment, or chemical methods. Discrete nanoparticles are not connected via covalent bonds. An arrangement of discrete nanoparticles is one in which each nanoparticle has a continuous surface, and although not wishing to be bound by theory, it is believed that such surfaces are completely covered by a thin layer of adsorbed water (e.g. a layer that is on the order of a few molecules in thickness). Again, without wishing to be bound by theory, in some embodiments, it is believed that high affinity ligands may also be in contact with nanoparticle surfaces. It will be appreciated that, in a close packed arrangement of discrete nanoparticles where adjacent spheres are in "contact," it is typically the thin adsorbed water or ligand layer of a sphere that contacts the thin adsorbed water or ligand layer of neighboring spheres. In contrast, discrete nanoparticles can be converted to non-discrete nanoparticles or particles by fusing the nanoparticles (e.g. via sintering). Such a process joins the continuous surfaces of discrete nanoparticles.

In some embodiments, the close packed layers of discrete nanoparticles described herein are prepared from solutions of the nanoparticles in a solvent. It will be appreciated that, in some embodiments, the nanoparticles maintain substantially the same shape in the close packed layers as in the solution. That is, the lack of any sintering or fusing of the nanoparticle arrangements described herein allows the solid phase nanoparticles (i.e., nanoparticles in a close packed arrangement) to remain discrete, and to substantially maintain the shape that they have in solution.

Interface

In various embodiments, the coatings of interest described herein have interfacial regions that are controllable. As used herein, the terms "interface" and "interfacial region" refers to the region that is common to two adjacent bilayers, or, if there is no overlap between bilayers, then to the region between two adjacent bilayers including the opposing faces of the adjacent bilayers. One or more aspects of the interface are controllable, such aspects including the thickness of the interfacial region, the sharpness of the interface, roughness of the interface, composition of the interface, and the like.

Interfacial Thickness

The interfacial thickness of the coatings of the present disclosure can be varied. For example, in some embodiments, the thickness of the interfacial region is controllable using the methods and materials described herein. As used herein, interfacial "thickness" refers to the thickness of a region that encompasses greater than 90% of the volume of nanoparticle material that overlaps with another bilayer. Where only two bilayers are present, the thickness of the individual interface is controllable. Where more than two bilayers are present, the thickness of each individual interface as well as the average thickness of all or a portion of the interfaces are controllable.

Figure 1B:
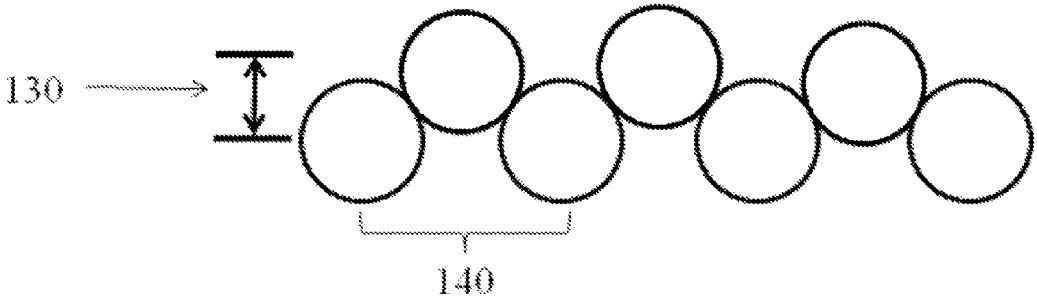
FIG. 1*b* provides a schematic representation of two adjacent monolayers of nanoparticles, wherein the monolayers are not tightly packed and the center-to-center spacing between the neighboring nanoparticles within a layer is larger than the diameter of a single particle.
Figure 1C:
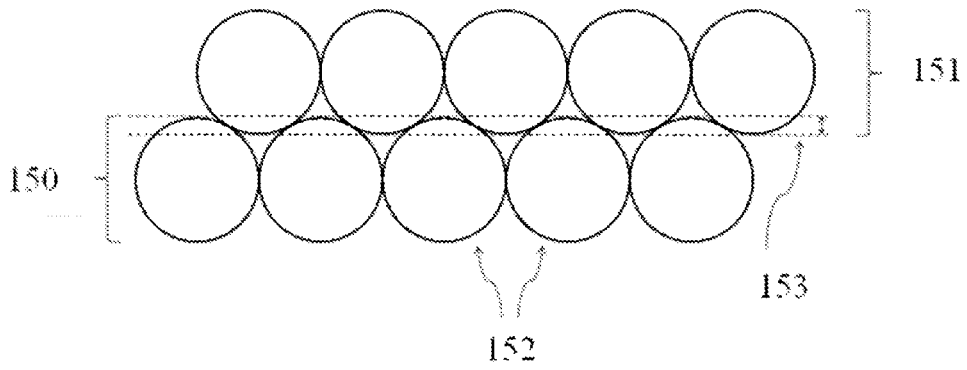
FIG. 1*c* provides schematic representations of a coating as described herein. The interfacial region is shown, as is the relationship between the packing density of nanoparticles and the thickness of the interfacial region.

One aspect that may be used to control interfacial thickness is the packing density of the individual nanoparticle layers. As illustrated in FIGS. 1*a* and 1*b*, interfacial thickness and nanoparticle packing density are generally inversely related (spheres are shown in the figures, although again, the nanoparticles may be non-spherical). In FIG. 1*a*, a tightly packed layer of nanoparticle 100 is disposed on a tightly packed layer of nanoparticle 101. Both nanoparticle types have the same diameter 110. The center-to-center distance between the layer of nanoparticle 100 and the layer of nanoparticle 101 is defined by 120 and is geometrically equivalent to the nanoparticle diameter 110. In FIG. 1*b*, a loosely packed layer of nanoparticles, results in a lower center-to-center distance between the two layers of nanoparticles 130. Furthermore, the in-plane center-to-center distance between neighboring nanoparticles 140 increases. Thus, tightly packed nanoparticle layers provide minimal interfacial thickness (FIG. 1*a*), whereas loosely packed nanoparticle monolayers provide an increased interfacial thickness (FIG. 1*b*). The theoretical minimum interfacial thickness is illustrated in FIG. 1*c*. Tightly packed layers 150 and 151 are made of rigid, uniform nanoparticles 152, each having diameter d (not labeled). Interface 153 has thickness $t_{int1}$, which is given by the equation $t_{int1}=0.19*d$. In some embodiments of the invention, then, the thickness of the interface between bilayers is minimized due to the close packing of nanoparticles in each bilayer.

In practice, the actual thickness of an interfacial region may or may not be determinable by various analytical methods. However, in some embodiments the thickness of the interface can be inferred from the thickness and number of bilayers and from the average diameter of the nanoparticles. For example, in a coating having a thickness of "$t_{coating}$," wherein "n" bilayers were deposited, the average bilayer thickness is $t_{coating}/n$, and the number of interfaces is n−1. Furthermore, if the coating uses nanoparticles having an average diameter "$d_{np}$" then the average interfacial thickness is defined by $(n*d_{np}-t_{coating})/(n-1)$. It will be appreciated that this equation is valid only where nanoparticles of a single diameter are used in the coating. In instances where a single bimodal or multimodal mixture of nanoparticles is used, or where a plurality of mixtures having nanoparticles of different diameters is used, bilayer thickness and interfacial thickness can be inferred using appropriate modification to the calculation.

For example, in some embodiments where unimodal nanoparticles are used, the average interfacial thickness is less than $0.5*d_{np}$, or less than $0.4*d_{np}$, or less than $0.3*d_{np}$, or less than $0.25*d_{np}$, or less than $0.23*d_{np}$. It will be appreciated that interfacial thicknesses of less than $0.2*d_{np}$ may indicate that the nanoparticles of each bilayer are not sitting within the crevices of adjacent layers. This may be due to a number of factors, such as the amount of polyelectrolyte present, the electrostatic stability between bilayers, the amount of time given to each bilayer to form an optimal close packed monolayer, etc.

Interfacial Sharpness

Figure 1D:
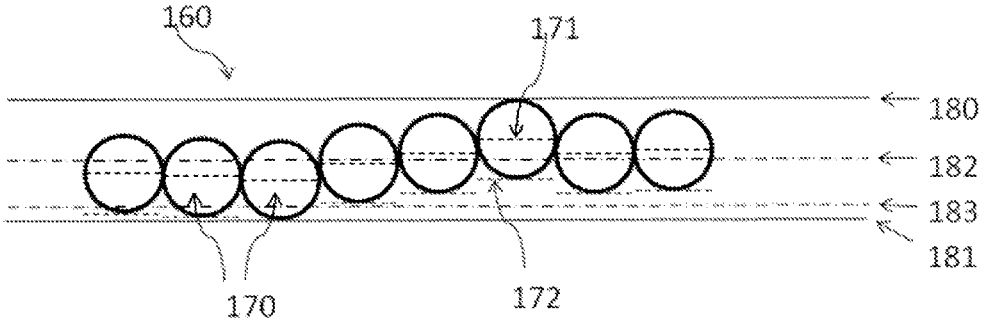
FIG. 1*d* provides a schematic representation of a monolayer, indicating variance from a flat two-dimensional layer.

The coatings of the present disclosure can vary in interfacial sharpness. For example, in some embodiments, the sharpness of the interfacial region is controlled using the methods and materials described herein. The interface sharpness can be described with reference to FIG. 1*d*. Monolayer 160 contains a plurality of nanoparticles 170. A pair of hypothetical, coplanar planes 180 and 181 can be drawn that encompass all of the nanoparticles in monolayer 160. For monolayer 160, plane 181 is referred to as the bottom extreme edge plane and plane 180 is referred to as top extreme edge plane. Each nanoparticle 170 has a corresponding center plane 171 that is coplanar with planes 180 and 181, a corresponding bottom edge plane 172 that is coplanar with planes 180 and 181, and a corresponding top edge plane (not labeled) that is coplanar with planes 180 and 181. Average center plane 182 is coplanar with planes 180 and 181, and is located to minimize the summation of the perpendicular distance from the plane to each of the center planes 171. Average bottom edge plane 183 is coplanar with planes 180 and 181, and is located to minimize the summation of the perpendicular distance from the plane to each of the bottom edge planes 172. Accordingly, the "sharpness" of an interface involving the bottom edge of monolayer 160 is inversely proportional to the perpendicular distance between average bottom edge plane 183 and extreme bottom edge plane 181.

In some embodiments, interfacial sharpness is a function of the quality of the close packed nanoparticle monolayers in adjacent bilayers. Thus, regardless of the thickness of the interface (i.e. the extent to which the two bilayers overlap, which may also be a function of the thickness of the polyelectrolyte and/or a function of the extent to which nanoparticles of one monolayer sit in the crevices of adjacent monolayers), the interface can be made sharp by providing close packed monolayers with the lowest possible average in-plane center-to-center nanoparticle distances and the fewest possible number of defects.

Interfacial Roughness

Also for example, in some embodiments, the roughness of the interfacial region is controlled using the methods and materials described herein. The term "roughness" refers to the inverse of sharpness.

Interfacial Composition

Also for example, in some embodiments, the composition of the interfacial region is controlled using the methods and materials described herein. As mentioned above, the interfacial region includes those portions of nanoparticles that overlap with an adjacent monolayer. Using the methods described herein, the compositions of the nanoparticles of adjacent monolayers are controllable. Thus, the composition of the nanoparticle material in the interfacial region is controllable. Furthermore, in some embodiments, it will be appreciated that polyelectrolyte may also be present in the interfacial region, and the identity of the polyelectrolyte material is controllable. Accordingly, the composition of material in the interfacial region is controllable.

Coating Properties

In some embodiments, the coatings of interest contain a plurality of bilayers, wherein each bilayer contains a monolayer of nanoparticles and a layer of polyelectrolyte. As used herein, the term "monolayer" refers to a single layer of nanoparticles arranged side-by-side (rather than stacked) relative to the plane of the substrate. FIG. 1*c* shows two monolayers 150 and 151 that are stacked one on top of the other.

In some embodiments, the number of bilayers is within the range of 2-10,000, or between 10-10,000, or between 20-500. In some embodiments, more than 2, or more than 5, or more than 10, or more than 15, or more than 20, or more than 30, or more than 50, or more than 100, or more than 200, or more than 300, or more than 500, or more than 1000 bilayers are present.

Because of the presence of crevices between nanoparticles and between nanoparticles of different monolayers, in some embodiments the coatings described herein are porous. In some embodiments, porosity is present even when a polyelectrolyte is present within the crevices, and even when a large amount of polyelectrolyte is deposited (i.e., the polyelectrolyte does not completely fill the crevices). In some embodiments, porosity of the films is constant throughout the film, although in other embodiments porosity is variable. Generally, porosity can be controlled within a range of values by a number of factors, such factors including the diameter and uniformity of the nanoparticles, the amount of polyelectrolyte deposited the concentration and identity and concentration of salt in the deposition solutions, and the like. In some embodiments, the extent of porosity of the coatings of interest is in the range of 0-0.6, or the range 0-0.5, or the range 0.1-0.4, or the range 0.1-0.3. It will be appreciated that the term "pores" refers to spaces between nanoparticles, and that such pores may be unfilled (i.e. under vacuum), filled, or partially filled. When filled, the pores may be filled with one or more gases, liquids, or solids, or a combination thereof.

In some embodiments, the pores of the coatings of interest are filled with air or an inert gas such as nitrogen or argon. In some embodiments, all or a portion of the pores may be filled with a material other than air or inert gases in order to alter the refractive index of the coating.

Characterization

As suggested by the foregoing, in some embodiments, the properties of the coatings of the invention are conveniently characterized by optical measurement techniques such as ellipsometry and the like. For example, refractive index, reflectivity, and other optical data may be used to characterize the coatings. Other non-optical techniques, such as profilometry, x-ray scattering, thermogravimetric analysis, atomic force microscopy, scanning electron microscopy, (SEM) and transmission electron microscopy (TEM) may additionally or alternatively be used to characterize the coatings. Such characterization data may be used to obtain coating thickness, average bilayer thickness, individual bilayer thickness (e.g. using TEM), degree of packing, local order, clarity, reflectivity, refractive index, haze, and the like. It will be appreciated that optical methods typically provide data that is averaged over an area, such as a 1 $mm^2$ spot or the like, whereas physical methods such as TEM provide data that may be more localized. Either source of data (localized or area-averaged) may be used to determine whether the coatings are suitable for the intended application.

In characterizing the coatings prepared using the methods described herein, certain measurements may be indicative of certain properties. For example, the coating's refractive index may be measured. Given the known refractive indices of the materials used for the nanoparticles and the polyelectrolyte, the measured refractive index can be used to determine nanoparticle packing density, volume fraction of polyelectrolyte, and volume fraction of void spaces (e.g. spaces filled not with nanoparticle or polyelectrolyte, but rather filled with ambient gases such as air or being under vacuum, which is a measure of porosity). This knowledge may also be used to control, for example, the refractive indices of the coatings. For example, a lower refractive index can be obtained by increasing the nanoparticle diameter, which increases the amount of void space between particles, and therefore increases the amount of air in the overall coating. For example, in some embodiments the coatings of interest have refractive indices shown in Table 1.

TABLE I

| Representative Material Sets | Nanoparticle Type | Effective RI |
|---|---|---|
| (PDAC/TM50) | $SiO_2$ | 1.26-1.30 |
| (PDAC/HS30) | $SiO_2$ | 1.33-1.38 |
| (PDAC/STUP) | $SiO_2$ | 1.23-1.26 |
| (PAH-GMA/SM30) | $SiO_2$ | 1.44-1.48 |
| (PDAC/X500) | $TiO_2$ | 1.75-1.83 |
| (CMC/NA7012) | $TiO_2$ | 1.82-1.94 |
| (PSS/NA7012) | $TiO_2$ | 1.85-1.94 |
| (PDAC/SvTiO2) | $TiO_2$ | 2.01-2.10 |

Abbreviations for Table 1:
PDAC polydiallyldimethyl ammonium chloride
PAH-GMA glycidyl methacrylate modified polyallylamine
CMC carboxymethylcellulose
PSS poly sodium-4-styrene sulfonate
TM50 anionic silica nanoparticles: 22 nm
HS30 anionic silica nanoparticles: 12 nm
STUP rod-like anionic silica nanoparticles
SM30 anionic silica nanoparticles: 7 nm
X500 anionic titania nanoparticles: 8 nm
NA7012 cationic titania nanoparticles: 15 nm
SvTiO2 anionic titania nanoparticles: 12 nm Coating Area The layer-by-layer deposition process, as described in more detail below, applies coating solutions to a substrate to build a coating on the substrate. The coating solutions may be applied to the entire area of the substrate, or may be applied to a defined region of the substrate. The term "coated area" as used herein refers to the area of the substrate upon which a coating is formed. In some embodiments, the tightly packed arrangement as described above for any individual bilayer covers at least 75%, or at least 85%, or at least 90%, or at least 95%, or at least 98%, or at least 99%, or at least 99.9% of the coated area. Furthermore, in some embodiments, the coatings prepared according to the methods disclosed herein have a tightly packed three-dimensional arrangement of nanoparticles over at least 75%, or at least 85%, or at least 90%, or at least 95%, or at least 98%, or at least 99%, or at least 99.9% of the coated area. In some embodiments, the substrate is intentionally masked or protected to prevent coating in certain areas, and the tightly packed arrangement as described above for any individual bilayer covers at least 75%, or at least 85%, or at least 90%, or at least 95%, or at least 98%, or at least 99%, or at least 99.9% of the non-masked area.

In some embodiments, the coated area has a surface area that is greater than 1 $in^2$, or greater than 4 $in^2$, or greater than 9 $in^2$, or greater than 16 $in^2$, or greater than 25 $in^2$, or greater than 50 $in^2$, or greater than 100 $in^2$. In some embodiments, the spray LbL methods of interest are applied in a continuous roll-to-roll fashion, and the total area covered by the coatings is several square feet or greater.

In some embodiments, methods are used for patterning the coating on the substrate surface. For example, the spray layer-by-layer (LbL) deposition methods disclosed herein can be applied using a masking technique or an etching technique to create patterned coatings on a substrate.

Coating Types and Relevant Properties

The methods and compositions of present disclosure can be applied in a variety of settings. In some embodiments, the methods describe herein are suitable for the preparation of multilayer photonic structures with optical interference effects. Examples of optical interference filters include constructive interference filters such as dichroic mirrors, Bragg stacks, Fabry-Perot etalons, or destructing interference filters such as anti-reflection structures and other filters known in the art. These filters are exemplary and produce optical interference effects. In some embodiments, the optical interference effects are in wavelength ranges from 200-2500 nm or 200-1500 nm. In some embodiments, and as mentioned below, the methods described herein are suitable for the preparation of dichroic mirrors. For example, a dichroic mirror coating may contain y1 layers of a first film and y2 layers of a second film, wherein: the first film comprises first nanoparticles and a first polyelectrolyte and has an average thickness $t_{film1}$; the second film comprises second nanoparticles and a second polyelectrolyte and has an average thickness $t_{film2}$; the first film has a refractive index of $n_{film1}$; and the second film has a refractive index of $n_{film2}$. In some embodiments, at least a portion of the layers of the first film alternate with at least a portion of the layers of the second film. In some embodiments, y1 and y2 are integers that are the same or differ by one, and all of the layers of the first film alternate with the layers of the second film. In some embodiments, y1 and y2 are integers that are different. In some embodiments, y1 and y2 are integers that are selected to result in desired optical thickness, given refractive indices $n_{film1}$ and $n_{film2}$ and thicknesses $t_{film1}$ and $t_{film2}$. In some embodiments, y1 is in the range 2-10000. In some embodiments, each layer of the first film comprises one or more bilayers (such as 1, 2, 3, 4, 5, 6, 7, 8, 9, 10, 15, 20, or more bilayers), wherein each bilayer comprises a monolayer of the first nanoparticles and a layer of the first polyelectrolyte. Furthermore, and each layer of the second film comprises one or more bilayers (such as 1, 2, 3, 4, 5, 6, 7, 8, 9, 10, 15, 20, or more bilayers), wherein each bilayer comprises a monolayer of the second nanoparticles and a layer of the second polyelectrolyte. In some embodiments, the first nanoparticles are made of a first material and the second nanoparticles are made of a second material that is different from the first material, and both materials are independently selected from the materials disclosed herein. Similarly, the first polyelectrolyte and the second polyelectrolyte may be the same or different. Furthermore, the first nanoparticles and second nanoparticles may have the same diameter or different diameters. In some embodiments, the coating has a maximum percent reflectance (% R) at a first wavelength ($\lambda_1$) in the visible spectrum. In some embodiments, the coating has a full-width at half maximum peak reflectance in the visible light region that is less than 200 nm, or less than 150 nm, or less than 100 nm, or less than 70 nm, or less than 50 nm. In some embodiments, the coating has a full-width at half maximum peak reflectance in the visible light region that is greater than 50 nm, or greater than 100 nm, or greater than 150 nm, or greater than 200 nm, or greater than 300 nm. In some embodiments $\lambda_1$ is in the ultraviolet region of the spectrum or in the infrared region of the spectrum. In some embodiments, $\lambda_1$ is in the ultraviolet region of the spectrum. In some embodiments $\lambda_1$ is in the infrared region of the spectrum. In some embodiments, the coating has a % R at the first wavelength that is at least 70% of the theoretical maximum at the first wavelength given $n_{film1}$, $n_{film2}$, $t_{film1}$, $t_{film2}$, y1, and y2. In some embodiments, the coating has a % R at the first wavelength is at least 50% greater, or at least 100% greater than the % R at any other wavelength in the visible range.

In some embodiments, and as mentioned below, the methods described herein are suitable for the preparation of antireflective coatings. As with dichroic mirrors, antireflective coatings include y1 layers of a first film and y2 layers of a second film, and all of the relevant disclosure with respect to dichroic mirrors applies here as well. In some embodiments, antireflective coatings may have y2=0 layers of a second film. However, instead of a peak in % R, the antireflective coatings have a minimum in % R at a desired wavelength. The location of the minimum in % R can be controlled by many variables, such as the material and arrangement of the nanoparticles, the identity of the polyelectrolyte, the extent of porosity, and the like.

In some embodiments, and as mentioned below, the methods described herein are suitable for the preparation of Fabry-Perot etalons. Again, these coatings involve layers of a first film and layers of a second film, and the above disclosure is relevant here. However, instead of a single peak in % R or a single minimum in % R, Fabry-Perot etalons exhibit two maxima in the percent transmittance (% T). In some embodiments, the two maxima are less than 200 nm apart. In other embodiments, the two maxima are greater than 200 nm apart. In some embodiments, each maximum has a full width at half maximum of less than about 100 nm. In other embodiments, each maximum has a full width at half maximum of greater than about 100 nm. In some embodiments, the two maxima are less than 200 nm apart in wavelength, and each maximum has a full width at half maximum of less than about 100 nm.

In some other embodiments, rugate filters, Bragg filters, bandpass filters, gradient index anti-reflection, and other multilayer interference optical elements are known from the art, may be suitable for the methods described herein.

The methods and materials described herein are not limited to only two types of films. In some embodiments, y3 layers of a third film, wherein each film has a thickness of $t_{film3}$ and refractive index of $n_{film3}$, may be present. Furthermore, in some embodiments, y4 layers of a fourth film, each having thickness of $t_{film4}$ and refractive index of $n_{film4}$, may be present. In some embodiments, there are 5, 6, 7 or more different films in the coatings of interest. Each of these additional films comprises one or more bilayers (such as 1, 2, 3, 4, 5, 6, 7, 8, 9, 10, 15, 20, or more bilayers) that comprise a monolayer of nanoparticles and a polyelectrolyte. Furthermore, the various films may be completely alternating, partially alternating, arranged in a block fashion, or any combination therefore. It will be appreciated that each "layer of a film" comprises first and second materials, wherein such materials are complimentary (e.g., are oppositely charged and suitable for layer-by-layer deposition). For example, the first material may be nanoparticles and the second material may be polyelectrolyte as described herein.

In some embodiments, the coatings of interest contain alternating layers of a high refractive index material and a low refractive index material. In some embodiments, the difference between the high index and the low index may be greater than 0.1, or greater than 0.2 or greater than 0.3, or greater than 0.4, or greater than 0.5, or greater than 0.6, or greater than 0.7, or greater than 0.8, or greater than 0.9, or greater than 1.0. In some embodiments, the refractive index of the high index material is greater than 1.75, whereas the refractive index of the low index material is less than 1.75. In some embodiments, the refractive index of the high index material is greater than 2.0, whereas the refractive index of the low index material is less than 2.0. In some embodiments, the low refractive index is less than 1.4. In some embodiments, the low refractive index is less than 1.3. In some embodiments the low refractive index is less than 1.25. Alternating layers comprising titania and silica nanoparticles are an example of such a material.

In some embodiments, the structure and properties of the coatings described herein are designed to form a multilayer photonic structure. In such embodiments, the bilayers are arranged to have optical interference effects.

In some embodiments, all or a portion of the film thicknesses (i.e. $t_{film1}$, $t_{film2}$, and optionally $t_{film3}$, $t_{film4}$, etc.) are selected to be $\frac{1}{8}*\lambda_1$ or $\frac{1}{4}*\lambda_1$ or $\frac{1}{2}*\lambda_1$, wherein $\lambda_1$ is a predetermined wavelength in the visible, IR, or UV spectrum. In some embodiments, some of the film thicknesses are non-harmonic relative to the predetermined wavelength $\lambda_1$.

Materials

Deposition Solutions

In embodiments, the coatings described herein are prepared, as described in more detail below, via a spray LbL deposition method. The spray LbL method involves alternately and repeatedly spraying a first deposition solution and a second deposition solution onto a substrate. The first and second deposition solutions each contain at least a coating material (e.g. nanoparticles or a polyelectrolyte) and a solvent, and may optionally contain other components (e.g. salts, etc.). Each repetition of application of the first and second deposition solutions creates a bilayer. The coating thickness can be adjusted by adjusting the number of bilayers that are deposited.

After each deposition solution is applied, a rinse solution can be applied to remove excess and unbound or loosely bound coating material. In some embodiments, the rinse solution is applied after application of the first deposition solution and prior to application of the second deposition solution, and is then further applied after application of the second deposition solution and prior to the re-application of the first deposition (i.e., for preparation of additional layers). As described in more detail herein, the rinse solutions comprise a solvent and may optionally contain other components (e.g. salts, etc.).

Nanoparticles

In embodiments, the coatings described herein are prepared using nanoparticles. Accordingly, in such embodiments, at least one of the deposition solutions (discussed below) comprises nanoparticles.

Materials that are suitable for the nanoparticles include metal oxides, metal nitrides, metal sulfides, metals, ceramics, quantum dots, fullerenes, carbon onions, inorganic polymers, organic polymers, and hybrid materials. Examples of metal oxides include oxides of silicon, titanium, cerium, iron, chromium, copper, zinc, silver, cobalt, and the like. Specific examples of metal oxides include silicon dioxide, titanium dioxide, cerium(IV) oxide, and the like. Examples of metal nitrides include nitrides of titanium, aluminum, and the like. Specific examples of metal nitrides include titanium nitride, aluminum nitride, and the like. Examples of metals include silver, gold, copper, iron, zinc, aluminum, and the like. Inorganic polymers and hybrid polymers such as polydimethylsiloxane, polymethylhydrosiloxane, polymethylmethacrylate and the like may also be used.

In some embodiments, the nanoparticles have an average diameter within the range 1-1000 nm, or 1-500 nm, or 1-300 nm, or 1-200 nm, or 1-100 nm, or 1-75 nm, or 1-50 nm, or 2-50 nm, or 3-50 nm, or 4-50 nm, or 5-50 nm. For example, the nanoparticles may have an average diameter that is greater than 1 nm, or greater than 3 nm, or greater than 5 nm, or greater than 7 nm, or greater than 10 nm, or greater than 15 nm, or greater than 20 nm, or greater than 50 nm. Also for example, the nanoparticles may have a diameter that is less than 500 nm, or less than 300 nm, or less than 100 nm, or less than 50 nm, or less than 30 nm, or less than 20 nm, or less than 15 nm, or less than 10 nm. Furthermore, the polydispersity index (PDI) of the average diameter of such nanoparticles may be in the range of 0.0-2.0, keeping in mind that the theoretical limit (i.e. for monodisperse nanoparticles) is a PDI of 0.0. The PDI may also be in the range 0.01-1.5, or 0.1-1.0. For example, the polydispersity may be less than 2, or less than 1.5, or less than 1, or less than 0.5, or less than 0.3, or less than 0.1, or less than 0.05, or less than 0.01. Also for example, the PDI may be greater than 0.01, or greater than 0.05, or greater than 0.1, or greater than 0.5.

The nanoparticles may be porous or nonporous, and may be hollow or solid. Furthermore, the nanoparticles may be comprised of a plurality of materials. For example, the nanoparticles may have a core-shell structure, wherein the core is a first material and the shell is a second material.

In some embodiments the nanoparticles contain a first binding group. The first binding group is a group that is complementary to the second binding group (described below). By "complementary" is meant that the first binding group and the second binding group together form a binding pair. A binding pair forms a non-covalent chemical bond which may be selected from an ionic bond, a hydrogen bond, an antibody-antigen bond, an avidin-biotin bond, hydrophobic interaction, or a Van der Waals interaction. Accordingly, the first binding group may be an ionic group, a hydrogen donor, or a hydrogen acceptor, or a precursor of any such group. A precursor is a group that can be converted to an ionic group, hydrogen donor, or hydrogen acceptor, for example upon a change in environmental conditions or upon reaction with an activating agent.

In some embodiments, each nanoparticle contains a plurality of first binding groups. In some embodiments, such first binding groups are disposed on or near the surface of the nanoparticles, such that they are exposed and available to interact with second binding groups and/or salt ions when either/both are present.

As mentioned previously, throughout this disclosure nanoparticles are cited as exemplary materials for forming the coatings of interest. It will be appreciated, however, that nanoparticles having shapes other than spheres may be used to prepare similar coatings using the spray LbL methods as described herein. For example, ellipsoidal, rod-shaped, and disk-shaped nanoparticles may be used. For disk-shaped particles in particular, the in-plane packing is the same as for spheres, whereas the out-of-plane packing involves little or no overlap of adjacent monolayers, as would be expected for the given geometry. In some embodiments, the nanoparticles are substantially nonspherical, in which case the nanoparticle has an average largest dimension within the range 1-1000 nm, or 1-500 nm, or 1-300 nm, or 1-200 nm, or 1-100 nm, or 1-75 nm, or 1-50 nm, or 2-50 nm, or 3-50 nm, or 4-50 nm, or 5-50 nm. For example, the nanoparticles may have an average largest dimension that is greater than 1 nm, or greater than 3 nm, or greater than 5 nm, or greater than 7 nm, or greater than 10 nm, or greater than 15 nm, or greater than 20 nm, or greater than 50 nm. Also for example, the nanoparticles may have an average largest dimension that is less than 500 nm, or less than 300 nm, or less than 100 nm, or less than 50 nm, or less than 30 nm, or less than 20 nm, or less than 15 nm, or less than 10 nm.

Polyelectrolyte

In embodiments, the coatings described herein are prepared using a polyelectrolyte. As used herein, the definition of a "polyelectrolyte" is a material that possesses multiple ionizable functionalities. In some embodiments, the polyelectrolyte is an organic polymer or an inorganic polymer. For example, the polyelectrolyte is a polymer having an average molecular weight greater than 100 Da, or greater than 500 Da, or greater than 1,000 Da, or greater than 5,000 Da, or greater than 10,000 Da, or greater than 50,000 Da, or greater than 100,000 Da, or greater than 1 M Da. The repeating units may be of any size, from methylene oxide to larger repeat units containing one or more functional groups and heteroatoms. In some embodiments the polyelectrolyte is a nanoparticle.

In some embodiments, the polyelectrolyte contains a binding group which is referred to herein as a "second binding group." The second binding group is a group that, along with a first binding group (described above with reference to the nanoparticles), forms a complementary binding pair. Accordingly, the second binding group may be an ionic group, a hydrogen donor, or a hydrogen acceptor, or a precursor of any such group. Where the first binding group is an ionic group, the second binding group is an ionic group, and the two binding groups have opposite charges, the two binding groups may be referred to as a binding pair. Where the first binding group is a hydrogen acceptor, the second binding group is a hydrogen donor, and vice versa.

In some embodiments, the polyelectrolyte is a polymer, and each polyelectrolyte molecule has a plurality of second binding groups distributed along the polymer chain. In some embodiments, the polyelectrolyte is a small molecule, and each polyelectrolyte molecule has one or more second binding groups.

Examples of suitable polyelectrolytes include poly(diallyl dimethyl ammonium chloride) (PDAC), polyacrylic acid (PAA), poly(styrene sulfonate) (PSS), poly(vinyl alcohol) (PVA), poly(vinyl sulfonic acid), Chitosan, CMC, PAH, hyaluronic acid, polysaccharides, DNA, RNA, proteins, LPEI, BPEI, polysilicic acid, poly(3,4-ethylenedioxythiophene) (PEDOT) and combinations thereof with other polymers (e.g. PEDOT:PSS), copolymers of the abovementioned, and the like. Other examples of suitable polyelectrolytes include trimethoxysilane functionalized PAA or PAH.

Salts

In embodiments, the coatings described herein are prepared using deposition solutions that comprise a salt. Each solution used in the LbL process may have a salt, and the identity and concentration of the salt is independently selected based on the needs of the solution and the overall process. For example, each deposition solutions may have a salt, and the rinse solution may also have a salt. The salts and salt concentrations in the deposition and rinse solutions need not be the same, although in some embodiments they are the same.

Examples of suitable salts include halide salts. Examples of halide salts include chloride salts such as LiCl, NaCl, KCl, $CaCl_2$, $MgCl_2$, $NH_4Cl$ and the like, bromide salts such as LiBr, NaBr, KBr, $CaBr_2$, $MgBr_2$, and the like, iodide salts such as LiI, NaI, KI, $CaI_2$, $MgI_2$, and the like, and fluoride salts such as $CaF_2$, $MgF_2$, LiF, NaF, KF, and the like. Further examples include sulfate salts such as $Li_2SO_4$, $Na_2SO_4$, $K_2SO_4$, $Ag_2SO_4$, $(NH_4)_2SO_4$, $MgSO_4$, $BaSO_4$, $COSO_4$, $CuSO_4$, $ZnSO_4$, $SrSO_4$, $Al_2(SO_4)_3$, and $Fe_2(SO_4)_3$, as well as similar nitrate salts, phosphate salts, fluorophosphate salts, and the like. Further examples include organic salts such as $(CH_3)_3CCl$, $(C_2H_5)_3CCl$, and the like. In some embodiments, monovalent salts are selected. In some embodiments, multivalent salts are selected. In some embodiments, salts are fully dissociable species in water. In some embodiments, mixtures of these and other salts are also suitable.

In some embodiments, the salt concentrations in the deposition solutions are selected to balance attractive and repulsive forces during the LbL deposition process, such that tightly-packed layers of nanoparticles are formed. A more detailed discussion of salt concentrations is provided below.

Solvents

In embodiments, the coatings described herein are prepared using deposition solutions that comprise a solvent. Each solution used in the LbL process may have a solvent, and the identity of the solvent is independently selected based on the needs of the solution and the overall process. For example, each of the deposition solutions may have a solvent, and the rinse solution may also have a solvent. The solvent in the deposition and rinse solutions need not be the same, although in some embodiments they are the same.

In some embodiments the solvents are selected from polar protic solvents, polar aprotic solvents, and non-polar solvents. Examples of polar protic solvents include water and organic solvents such as alcohols (ethanol, methanol, etc.) and acids (formic acid, etc.). Examples of polar aprotic solvents include ethers such as tetrahydrofuran, dimethyl ether, and diethyl ether, sulfoxides such as dimethyl sulfoxide, and amides such as dimethyl formamide. Examples of non-polar solvents include alkanes such as hexane and pentane. In some embodiments, mixtures of such solvents are also suitable. For example, in some embodiments a mixture of an alcohol and water such as a 95/5 mixture of water and ethanol may be used for the deposition solutions, the rinse solution, or all three solutions. In some embodiments, water is used for the deposition solutions and the rinse solution. In some embodiments, water containing salts and other additives is used for the deposition and rinse solutions.

The salt in the deposition solutions and rinse solutions may be a pH modifying agents. Such pH modifying agents include strong and weak acids and bases that are commonly used as buffers. For example, sodium hydroxide, hydrochloric acid, ammonium hydroxide, acetic acid, tetramethylammonium hydroxide, tetraethylammonium hydroxide, nitric acid, and the like may be used. A more detailed discussion of the effect of solution pH is provided below.

As mentioned, in some embodiments a rinse solution is applied to the coating after each layer is deposited. The rinse solution can comprise any solvent mentioned above, and in some embodiments the rinse solution contains the same solvent as the deposition solutions. For example, in some embodiments the rinse solution is water, such as deionized water. The rinse solution may also contain a salt which may be the same or different from the salt(s) used in the deposition solution. The rinse solution may further contain a pH modifying agent such that the pH of the rinse solution is controlled. For example, in some embodiments the pH of the rinse solution is maintained in the range 1-7, and in some embodiments the pH of the rinse solution is maintained in the range 7-14. In some embodiments, the rinse solution may be selected in a manner consistent with each deposition solution.

Preparation

In embodiments, the coatings described herein are prepared using a layer-by-layer (LbL) deposition method. In some embodiments, the LbL deposition method is a spray, dip, roll, slot die, spin, spin-dip, inkjet printed, or combinations thereof. The LbL spray deposition method uses at least two deposition solutions and at least one rinse solution, which are described in more detail herein. For the purposes of the discussion below, the LbL process is carried out using two deposition solutions—a "first deposition solution" containing nanoparticles and a "second deposition solution" containing a polyelectrolyte—as well as a single rinse solution. It will be appreciated that such discussion is not meant to be limiting, and applies to LbL processes using more than two deposition solutions, or using nanoparticles in the second deposition solution and polyelectrolytes in the first deposition solution, or using more than one rinse solution, etc.

In preparing coatings using the spray LbL method, a plurality of bilayers is prepared by alternate spray deposition of the two deposition solutions. Initial spraying of the first deposition solution provides a layer (e.g., a monolayer) of nanoparticles. Subsequent spraying of the second deposition solution provides polyelectrolyte, thereby forming a bilayer. In other embodiments, initial spraying of the second deposition solution provides a layer of polyelectrolyte, and subsequent spraying of the first deposition solution provides a monolayer of nanoparticles, thereby forming a bilayer. As discussed above, it will be appreciated that the deposition of the polyelectrolyte may result in a continuous discrete layer of polyelectrolyte (i.e., one that wholly or partially separates the nanoparticles of one bilayer from those of an adjacent bilayer) or may result in polyelectrolyte located substantially within the interstitial spaces between nanoparticles.

In embodiments, the deposition solutions remain stable throughout the spraying portion of the deposition process. By "stable" is meant that substantially no flocculation of the nanoparticles occurs. In a stable solution the nanoparticles tend to keep a minimum average distance away from other nanoparticles, wherein the minimum distance is sufficient to avoid flocculation. Avoidance of flocculation during deposition simplifies solution handling practices (e.g. by avoiding clogging of spray nozzles, etc.), and furthermore helps to ensure that uniform close-packed nanoparticle monolayers are formed.

In some embodiments, then, the zeta potential of the nanoparticles in the first deposition solution is large enough such that the solution is stable prior to and during the time that the first deposition solution of nanoparticles is sprayed onto the surface. Suitable zeta potentials include, for example, greater than about 5 mV, or greater than about 10 mV, or greater than about 15 mV, or greater than about 20 mV, or greater than about 30 mV, or greater than about 40 mV, or greater than about 50 mV. A variety of factors can be modified to obtain a desired zeta potential. For example, zeta potentials can be modified by selection of the concentration and identity of salts present in the solution, the pH of the solution, and the like. In some embodiments, the zeta potential is invariant with pH, meaning that the zeta potential has reached a plateau with respect to pH.

Formation of a close packed monolayer of nanoparticles can be conceptualized as a two-dimensional flocculation. Accordingly, the deposition solution transitions from stable to unstable at a point during the deposition process. By "unstable" is meant that the nanoparticles are able to condense and form closely packed arrangement. In an unstable solution, the nanoparticles do not necessarily maintain a minimum distance that avoids flocculation.

In some embodiments, the zeta potential of the nanoparticles in the first deposition solution decreases after it has reached the surface upon which a coating is being formed. The decrease is sufficient to convert the solution from stable to unstable. Suitable zeta potentials include, for example, less than about 15 mV, or less than about 10 mV, or less than about 5 mV. In some embodiments, the effect of the surface charge, as measured by zeta potential, is shielded due to the presence of salt. Salt induced shielding is a well-known concept in the art of colloidal solutions.

It will be appreciated that the foregoing discussion of zeta potentials is provided without intending to limit the invention by theory. In particular, actual zeta potentials may or may not conform to the above-described theory, and may or may not be measurable with known techniques.

Regardless of whether or not the zeta potentials may be measured, certain physical manifestations of the stability/instability of the solutions and coatings described herein will be readily apparent. For example, deposition solution stability can be observed due to the lack of flocculation that occurs. Instability of the solutions once applied to the surface can be observed via the formation of close packed nanoparticle arrangements. These and other observations may be used to confirm the stability/instability and the transition there-between of the solutions of interest.

Without wishing to be bound by theory, it is observed that several other considerations may be noted regarding the stability/instability properties of the materials and methods of interest. First, at certain times a high zeta potential is useful and desirable in that it increases the affinity of nanoparticles for the oppositely charged underlying film. That is, after deposition of the polyelectrolyte, the surface is charged oppositely from the nanoparticles, and therefore presents a surface that has an affinity for the nanoparticles. The affinity is a function of the nanoparticles' zeta potential. Second, a low zeta potential is useful and desirable in that it increases the affinity of nanoparticles for similarly charged nanoparticles in the same monolayer. That is, within any particular monolayer, the zeta potential of the nanoparticles must be low enough, or the electrostatic effect of the high zeta potential must be shielded, such that the nanoparticles are able to pack into a close packed arrangement. Zeta potentials that are too high may result in incomplete monolayer coverage. These two competing factors can be balanced by adjusting the ionic strength and pH of the deposition solutions, which allows the charges on the nanoparticles to be screened from each other. Such screening allows the nanoparticles to approach each other as they orient on the surface. At close enough center-to-center distances, van der Waals attractive forces become important in keeping the nanoparticles in a close packed arrangement. In some embodiments, the subsequent application of rinse solution may be used to increase the zeta potential, such that the affinity for the next deposition solution will be high.

In some embodiments, the ionic strength and pH of the deposition solutions are maintained such that the solutions are stable (i.e. no flocculation occurs). In some such embodiments the solutions are stable but only just so—i.e. any slight change in pH or ionic strength causes the solutions to become unstable (as evidenced by the occurrence of flocculation). In such a stable solution the nanoparticles will be able to approach one another as closely as possible without adhering and causing flocculation.

By controlling the pH and ionic strength of the deposition solutions, the zeta potential of the nanoparticles can be maximized. In some embodiments, the pH is maintained such that the zeta potential is invariant with pH (i.e. the zeta potential is at a plateau with respect to pH). Furthermore, the ionic strength is increased (e.g. using dissolved salts) to a level that allows for some shielding of the charges at the nanoparticle surfaces. At such pH and ionic strength levels, the deposition solution is stable, yet the nanoparticles bind tightly to the underlying surface. Methods for determining the optimum pH and ionic strength levels include, for example, salting out a solution and then operating just under the observed salt concentration.

With the deposition of each bilayer, the coating grows in thickness. Thus, it is possible to graph the coating thickness (e.g. an averaged value as determined via optical or physical measurements) as a function of the number of bilayers deposited. The coating growth rate may be defined as the slope of such a graph. In some embodiments, the coating growth rate is within 10%, or within 5%, or within 3% of the ideal value, wherein the ideal value is 81% of the diameter of the nanoparticles (and is calculated assuming that the nanoparticles are uniform, rigid spheres and that they form perfect three-dimensional close packed arrangements, with minimal contribution due to the presence of the polyelectrolyte).

In some embodiments, however, growth rates that deviate from the ideal value may be obtained due to various factors. For example, although in some embodiments the polyelectrolyte that is alternately deposited with the nanoparticles does not substantially increase the thickness of the bilayers (e.g. because the polyelectrolyte merely resides in the crevices between nanoparticles or because only a small amount of polyelectrolyte is deposited), in other embodiments the polyelectrolyte does substantially increase the bilayer thickness. Certain polyelectrolytes in particular result in increased bilayer thickness. For example, acrylate-substituted polyamine polymers can be used as the polyelectrolyte in a manner that results in average bilayer thicknesses exceeding the nanoparticle diameter. Other polyelectrolytes may also be used, particularly when sufficient polyelectrolyte is deposited to form layers of definable/discernable thickness.

In some embodiments, desired coating growth rates may be obtained by selecting nanoparticles of appropriate size. In some instances the selection of an appropriate combination of differently sized nanoparticles may be used to further tune the growth rate and/or properties of the resulting coatings. In some embodiments it is desirable to keep the smallest diameter nanoparticles nearest to the interfaces with other bilayer types, with the substrate, or with the interface with air. On the other hand, a rougher interface may be obtained by keeping the bigger particles at the interface.

Mixtures of nanoparticles of different sizes can be used to further tune coating growth rates. Characteristics that may be considered when employing multiple nanoparticle sizes include diffusion rates of the nanoparticles, charge/surface area ratio, and number density of the various diameter particles. For example, mixtures of nanoparticles that differ in average diameter by 2, 3, 4, 5, 6, 7 fold or more can be used in different ratios. For example, a 50-50 mixture of 40 wt % 7 nm nanoparticles and 40 wt % 50 nm nanoparticles (average diameters) results in a film that has substantially the same thickness of a film that is assembled from only 40 wt % 7 nm nanoparticles. Intended use of the coatings is also a consideration in some embodiments. For example, selecting larger nanoparticles, which minimally scatter light at optical wavelengths (such as nanoparticles having an average diameter greater than 70 nm), can be appropriate for more efficiently depositing optical films, as larger nanoparticles provide higher bilayer growth rates. In some embodiments larger nanoparticles may be used to create films with lower refractive indices.

The polyelectrolyte provides additional variables to be considered in preparing the coatings of interest. For example, when larger nanoparticles are used (e.g., larger than 40 nm average diameter), lower molecular weight polymers (e.g., lower than 20,000 Da) may be used in order to lower the amount of haze in the resulting coating. Without wishing to be bound by theory, it is believed that the lower molecular weight polyelectrolyte helps smooth the transition from the high refractive index (RI) of the nanoparticle to the low RI of air. Alternatively or in addition, other technologies like porous silica or sol-gel synthesized nanoparticles may be used to alter the refractive index of the coating.

In some embodiments, coatings may be prepared using two or more types of bilayers, wherein the types of bilayers differ, for example, in the materials used. For example, a coating may be made from two types of bilayers, wherein one bilayer is formed from PDAC and $SiO_2$ nanoparticles, and the other bilayer is formed from PDAC and $TiO_2$ nanoparticles. The two types of bilayers may be alternated, or may be deposited in "films" (e.g. five bilayers formed from PDAC and $SiO_2$ is referred to as a film of PDAC/$SiO_2$, and ten bilayers formed from PDAC and $TiO_2$ is referred to as a film of PDAC/$TiO_2$).

In some embodiments of building a stack containing more than two types of bilayers, similar process conditions are used for the bilayers. An example of similar process conditions is to use two different types of similarly charged nanoparticles (e.g. both are anionic or cationic) with a single type of oppositely charged polymer. Alternatively or in addition, the pH conditions of the solutions containing the various types of materials may be equal or similar (e.g. within a couple pH units from one another). Alternatively or in addition, the pH conditions of the rinse solution may be the same or similar (e.g. within 2 pH units) compared with the deposition solutions. Another example of similar process conditions is to have similar ionic conditions for the various deposition and rinse solutions. By similar ionic conditions is meant, for example, similar ionic strength (within 10%, or within 20%), and/or similar counter ion type, and/or similar ion on-off rates ($k_D$ or ion exchange strength).

As mentioned above, the term "coated area" as used herein refers to the area of the substrate upon which a coating is formed. In some embodiments the coated area is the same as the area to which coating solutions are applied, although it will be appreciated that in some embodiments such areas are not exactly identical. For example, where coating solutions are applied (e.g. sprayed) to a substrate held in a vertical position, some coating solution may travel down the substrate due to gravitational forces and form a coating over an area that was not directly subjected to the application of coating solution.

Throughout the coating process, the temperature of the coating and the environment surrounding the coating may be maintained within a desired range. Such range may extend below room temperature, such as to 15° C., or 10° C., or 5° C., or 0° C., or lower if desired. Such range includes temperatures that are above room temperature, such as 50° C., or 75° C., or 100° C., or 150° C. In some embodiments, the temperature of the coating and the environment is not regulated, such that the temperature remains approximately at ambient (i.e. room) temperature.

In some embodiments, throughout the coating process the temperature of the coating and the environment surrounding the coating is maintained below certain threshold temperatures. For example, in some embodiments the temperature is maintained below the sintering temperature of the nanoparticle material. In some embodiments the temperature is maintained below the temperature required for hydrothermal treatment of the coating. In some embodiments the temperature is maintained below the calcination temperature of the coating (i.e., the temperature required to remove all or most of one of the components of the coating such as the polyelectrolyte, wherein such temperature may also be sufficient to fuse all or some of the nanoparticles). In some embodiments the temperature is maintained below the temperature required to fuse the nanoparticles.

In some embodiments, throughout the coating process the pressure of the environment surrounding the coatings may be maintained within a desired range. Such range includes reduced pressures such as 90 kPa, or 80 kPa, or 70 kPa, or 50 kPa, or 25 kPa. Such range also includes increased pressures such as 110 kPa, or 120 kPa, or 150 kPa, or 200 kPa. In some embodiments the pressure is not regulated such that the pressure remains approximately at ambient (i.e. standard) pressure.

Although spray LbL is described above as exemplary, it will be appreciated that other forms of LbL deposition can be used to prepare coatings of interest. For example, dip LbL may be used. Alternative deposition methods that involve electrostatic-driven assembly of nanoparticle coatings may also be used. Appropriate modifications and considerations will be apparent as the method of deposition is varied.

As illustrated in the examples, a process window may be observed within which the methods of the disclosure are less sensitive or insensitive to certain variables. For example, and without wishing to be bound by theory, salt concentrations in the deposition solution and rinse solution may play a role because of the salts' ability to shield similar charges, thereby allowing similarly charged nanoparticles to approach one another and form a close packed arrangement. However, if too much salt (i.e. electrostatic charges are shielded to the extent that attractive colloidal forces are dominant) is used the nanoparticles may become unstable in solution and begin to flocculate, thereby preventing formation of a close packed monolayer. As illustrated in the examples, a window of salt concentrations can be determined, and within that window the coating growth rate (which is a measure of bilayer thickness) remains relatively constant. In some embodiments the coating growth rate plateau corresponds to the theoretical growth rate value of $0.81*d_{np}$. In some embodiments the coating growth rate plateau corresponds to the theoretical growth rate value of $0.71*d_{np}$.

In some embodiments, the salt concentration in the deposition solution can range between 1 mM and 1000 mM or between 10 mM and 100 mM or between 30 mM and 80 mM. In some embodiments the salt concentration in the deposition solution is greater than 1 mM, 10 mM, 100 mM or 500 mM. In some embodiments, the salt concentration is less than 500 mM, 100 mM, 70 mM, 50 mM, or 20 mM. In some embodiments, the salt concentration in the rinse solution can range between 0 mM and 100 mM. In some embodiments, the salt concentration in the deposition and/or rinse solutions is varied with salt identity. For example, for solutions containing TM50 silica nanoparticles, salt concentrations of NaCl ranging from about 45 mM to about 60 mM provide a window of film growth rates that are independent of salt concentration. Also for example, for solutions contains AS40 silica nanoparticles, salt concentrations of tetramethylammonium chloride ranging from about 50 mM to about 100 mM provide a window of film growth rates that are independent of salt concentration.

Efficiency

In embodiments, the methods of interest provide for improving the transfer efficiency, speed, uniformity and/or combination thereof of LbL deposition of coatings. In some embodiments, the methods of interest provide for improving the efficiency, speed, uniformity and/or combination of LbL spray deposition of coatings. While spray is exemplary and discussed throughout this application, it is not intended to be limiting. In embodiments, methods of interest provide for improving the efficiency, speed, uniformity and/or combination of LbL flow, dip, spin, and the like deposition of coatings. Compared with previously known spray LbL methods, the methods of interest allow for increased transfer efficiency in the spray deposition of coating components. As used herein, the term "transfer efficiency" refers to the number of molecules in the deposition layer that become incorporated into the coating versus the number of molecules that are in the deposition layer. As it relates to this discussion, idealized transfer efficiency can be determined by taking the ratio of the number of molecules that are incorporated into the film to the total number of molecules applied to the surface. In practice, transfer efficiency more closely relates to ratio of the number of molecules incorporated into the film to the total number of molecules exiting the nozzle used for deposition solution. However because losses during the transport of solution to the surface can be addressed through techniques well known in the art, including air flow in the deposition region, this aspect of transfer efficiency will not be addressed. Molecules that are not incorporated into the coating are, for example, removed from the substrate via one of the methods described herein (e.g., washed away via the rinse solutions, blown away by an air knife, etc.). Accordingly, a first method has an increased transfer efficiency compared with a second method if, using the first method, there is a greater percentage of molecules in the deposition layer that are incorporated into the coating compared with the second method. It is appreciated that some of the mentioned methods may have relevance in other LbL processes and the disclosed methods are not intended to be limited to spray deposition. For example the mentioned methods have relevance with to layer by layer deposition processes via dip, spin, spin-spray, spray or combinations thereof. While each technique variation has its own unique advantages, the mentioned methods enable large scale practice of the layer-by-layer assembly method. In some embodiments, a bilayer or plurality of bilayers may be formed areas that are greater than 9 square inches, 16 square inches, 25 square inches, 100 square inches, 1000 square inches, 10,000 square inches or greater. In some embodiments, a bilayer or plurality of bilayers may be formed onto large areas rapidly with rates that are greater than 9 square inches, 16 square inches, 25 square inches, 100 square inches, 1000 square inches, 10,000 square inches per minute or greater. In some embodiments, the process time required to form a bilayer, or $t_{bilayer}$, is less than two minutes, less than 1 minute or less than 30 seconds. In some embodiments, the speed with which the substrate moves relative to the deposition method is greater than 1, 5, 10, 15, 25, 50, or greater than 50 m/min. The mentioned methods are relevant to layer-by-layer assembly and take advantage of self-limitation and lead to precision and uniformity. Other coating techniques such as slot-die coating, spin coating, spray coating, and others known in the art, do not take advantage of self-limitation, leading to precision solely dictated by the precision of the equipment or process, except when use in conjunction with the methods described herein. In some embodiments, the total variation in thickness of the resulting bilayer or plurality of bilayers on a surface, is less than 10%, or less than 8%, or less than 5%, or less than 3%, or less than 2%, or less than 1.5%, or less than 1%, where the surface is greater than 4 square inches, or 10 square inches, or 50 square inches, or 1000 square inches, or 5000 square inches, or 10000 square inches, or greater.

Figure 3:
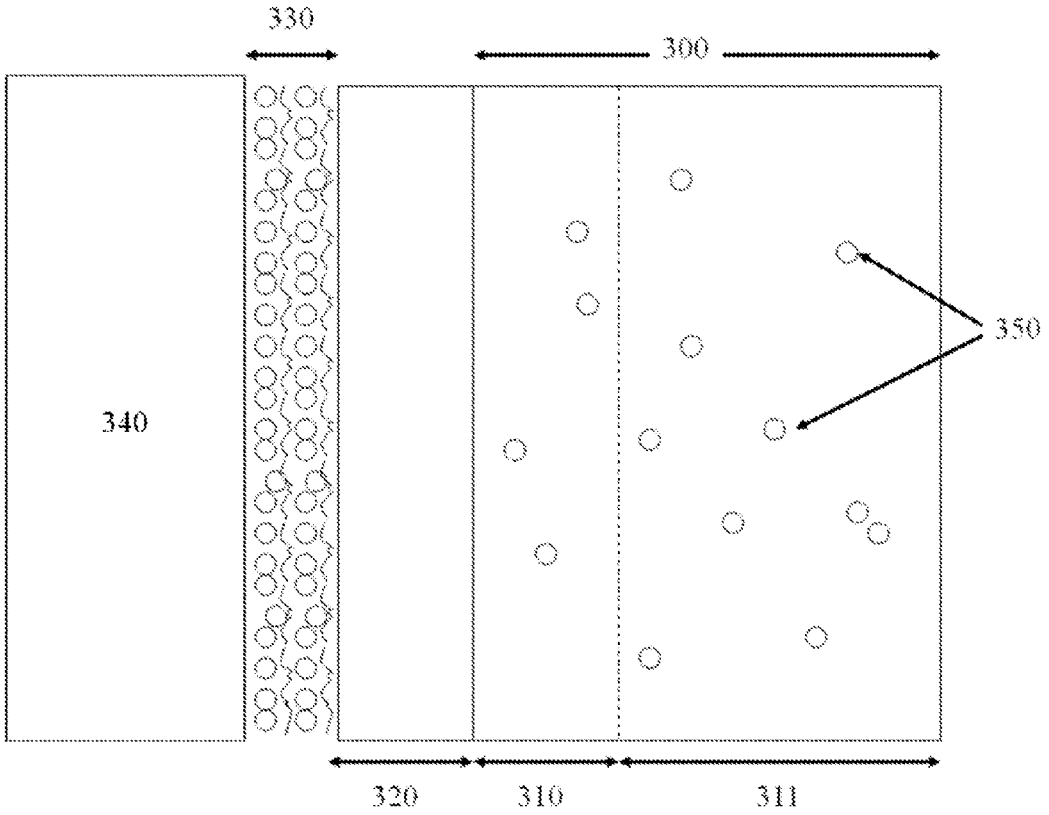
FIG. 3 provides a schematic model of the LbL deposition process.

Without wishing to be limited by theory, FIG. 3 provides a schematic description of what is believed to occur during the LbL deposition process. Specifically, FIG. 3 is a schematic showing the coating after deposition of a few coating layers and associated applications of a rinse solution. It will be appreciated that FIG. 3 shows a two-dimensional representation of what is, in fact, a three-dimensional process. Accordingly, certain effects originating from the 3-D nature of the LbL deposition or binding kinetics, are also present during depositions, and those of skill in LbL coatings will appreciate such effects.

In FIG. 3, substrate 340 is covered on one surface by film 330. Film 330 contains alternating layers (not labeled) of nanoparticles and polyelectrolyte. Film 330 is prepared using the LbL deposition methods described herein. For example, the method involves (in part) application of a first deposition solution (either polyelectrolyte or nanoparticles) followed by waiting a period of time $t_{dep}$ to allow deposition material from the first deposition solution to bind to the surface. After time $t_{dep}$, a rinse solution is applied, followed by waiting a period of $t_{rinse}$. Without wishing to be bound by theory, it is believed that a wait time $t_{rinse}$ is required to allow loosely unbound or excess material near Film 330 to diffuse sufficiently away from the surface prior to removal. Following the application of the first deposition solution and rinse solution, along with associated wait times, the result is a layer by layer assembled half bilayer (also referred to herein as a coating layer). The sum of all wait times is $t_{halfbilayer}$. Subsequently, a second deposition solution (polyelectrolyte or nanoparticles that are complementary to the material of the first deposition solution) is applied followed by waiting a period of time $t_{dep2}$ to allow deposition material from the second deposition solution to bind to the surface. After $t_{dep2}$, a rinse solution is applied. This process forms a bilayer, and is repeated to form a plurality of bilayers. The time required to form a bilayer is $t_{bilayer}$. In some embodiments multiple rinse stages are used, where a rinse solution is applied following another rinse solution application, prior to the application of deposition solution. In some embodiments, there are multi-stage rinses that require additional $t_{rinse}$ times, such as $t_{rinse2}$, $t_{rinse3}$, $t_{rinse4}$, $t_{rinse5}$, or additional times. In some embodiments, there are multi-stage depositions that require additional $t_{dep}$ times, such as $t_{dep2}$, $t_{dep3}$, $t_{dep3}$, $t_{dep4}$, $t_{dep5}$, or additional times. In these cases, $t_{halfbilayer}$ is increased by adding the additional relevant wait times.

It will be appreciated that, when a solution is applied to a "surface" (e.g., as described in the previous paragraph), the term "surface" may refer to a liquid surface or a solid surface. For example, the first time a deposition solution is applied to a substrate (i.e., to form a first portion of a bilayer), the deposition will be applied directly to the solid surface of the substrate. Subsequently, a rinse solution is applied to the "surface" which means that the rinse solution is applied to the liquid surface of the deposition layer present on the substrate from the prior application. Subsequently, a deposition solution is again applied to the "surface" which means that the deposition solution is applied to the combined rinse layer and deposition layer from the previous application of deposition solution. In each of these cases, spray application of a solution is referred to as being applied to the "surface."

Returning now to FIG. 3, above film 330 is Residual Rinse Layer 320. Residual Rinse Layer 320 contains rinse solvent and may further contain film-forming material (i.e. nanoparticles and polyelectrolyte, not shown in FIG. 3) that has not adhered to the surface to become part of the coating. Such non-adhered film-forming material may, for example, be excess material if the underlying film is tightly-packed and lacks vacant binding sites, or may be material that has not yet completed the diffusion-controlled migration to a binding site on the surface. The residual rinse layer is formed when rinse solution is applied to the surface, e.g., after application of a deposition solution and allowing a time ($t_{dep}$) to elapse such that deposition material from the deposition solution can diffuse to the surface and bind to a binding site.

In FIG. 3, Deposition Layer 300 is shown above Residual Rinse Layer 320. Generally, a deposition layer represents a layer of deposition solution that is applied to a surface in a deposition step. In FIG. 3, Deposition Layer 300 represents deposition solution that was applied directly onto Residual Rinse Layer 320. Deposition Layer 300 contains film-forming material, such as 350, dissolved in solvent. The film-forming material from Deposition Layer 300 must diffuse through Residual Rinse Layer 320 in order to reach and bind to film 330 on substrate 340.

It will be appreciated that, when the solvent in a deposition layer and the solvent in the underlying residual rinse layer are the same solvents, the two layers will merge into a single layer with a gradient in concentration of film-forming material. The layers are distinguished in this description for ease of understanding, and in practice, such layers may be distinguished based on concentration of deposition material therein.

Within Deposition Layer 300 is Depletion Depth 310. The depletion depth of a deposition layer is the thickness of the deposition layer that contains sufficient film-forming material to saturate every available binding site in the underlying coating (or provide the self-limited tightly packed monolayer). The depletion depth is dependent, for example, on the concentration of the deposition layer and the identity of the film-forming material (e.g., diameter of the nanoparticles, etc.). Beyond Depletion Depth 310 is Residual Deposition Region 311, which also contains film-forming material dissolved in solvent. The film-forming material in Residual Deposition Region 311 is not likely to reach and bind to Film 330 because it is excess material, the film is self-limiting, and the excess material must diffuse a greater distance compared with the material in Depletion Depth 310.

Film 330 grows in thickness via formation of monolayers of the deposition materials. The deposition material is supplied from the sprayed deposition layers. Therefore the minimum amount of time required for formation of a tightly packed monolayer is equal to the time required for a particle at the farthest edge of the depletion depth to diffuse through the depletion depth and through the residual rinse layer to reach the film. For example, if the residual rinse layer is 10 μm and the depletion depth is 10 μm, then the minimum amount of time required for formation of a saturated (i.e. tightly packed) monolayer is the time that it takes a molecule of the deposition material to diffuse through 20 μm of the deposition and rinse solutions. This is the minimum amount of time because the actual time may be greater, such as where there is required lateral diffusion for molecules to locate a vacant binding site. Each molecule or particle of deposition material must locate a binding site in order to be incorporated into the film. In this specification, the term "diffusion time" in the context of deposition materials refers to the amount of time it would take a molecule or particle from a deposition solution layer to diffuse to the surface given the molecule or particle's distance from the surface and the diffusion rate for the particle or molecule. The term "average diffusion time," then, is the diffusion time averaged over all or a representative portion of the molecules or particles in a deposition solution layer.

The residual rinse layer prevents contact of the deposition solution directly with the growing film. As described immediately above, it is believed that the primary transport mechanism of a nanoparticle or polymer through the sprayed deposition layer through the residual rinse layer is diffusion. Therefore, processing time is limited by the diffusion limitations of the polymer/nanoparticle (e.g., size of the polymer/nanoparticle, temperature, viscosity of the solution, etc.) and other parameters known in the art. Furthermore, since diffusion depends on the square root of time, the required waiting time quadruples for each doubling of the required diffusion distance. It is therefore possible to first determine the amount of time required to form a film, giving nanoparticle or polymer properties, temperature, viscosity of the solvent, thickness of the residual rinse layer and the sprayed deposition solution using the diffusion equations known in the art. It is also therefore possible to reduce the time required for film formation by reducing the depletion depth and/or reducing the thickness of the residual rinse layer. In some embodiments the residual rinse layer is reduced to a thickness of less than 10 μm, less than 5 μm, less than 1 μm, less than 100 nanometers, or less than 10 nanometers. Rinse layer thicknesses (and other solvent-based layer thicknesses) can be measured using known methods such as, for example, spectral reflectance.

It is appreciated that in some instances, nonuniformity in the residual rinse layer may be present due to fluid instabilities (e.g. fingering or channeling). Therefore in some embodiments, the residual rinse layer is smoothed and/or the thickness of the layer is reduced. In some embodiments, the sprayed deposition layer is smoothed and/or the thickness of the layer is reduced. Smoothing of such layers can be accomplished by any means described herein, such as with a stream of air or another gas, the use of one or more contact rollers, etc. Reducing the thickness of such layers can be accomplished by any means described herein, such as with a stream of air or another gas, the use of contact rollers, evaporation of solvent, increased web tension in roll-based systems, etc.

It will be appreciated that a reduction in the time required for formation of each monolayer or half bilayer equates to a reduction in the time required for formation of the film as a whole. There is, however, a trade-off between speed and transfer efficiency. For example, the wait time between deposition and rinse can be reduced by increasing the concentration of the deposition solution (thereby reducing the depletion depth). However, a higher concentration may lead to decreased transfer efficiency as more deposition material is present beyond the depletion depth.

In some embodiments, the minimum wait time, $t_{dep\text{-}min}$, wherein minimum wait time is the minimum amount of time required to form a monolayer, between deposition and rinse is less than 5 minutes, or less than 2 minutes, or less than 1 minute, or less than 45 seconds, or less than 30 seconds, or less than 20 seconds, or less than 10 seconds, or less than 8 seconds, or less than 4 seconds. In some embodiments, the minimum wait time is between 4 seconds and 30 seconds, or between 4 seconds and 20 seconds, or between 4 seconds and 15 seconds. In some embodiments, $t_{dep}$ is equal to $t_{dep\text{-}min}$.

In some embodiments, spray efficiencies (eff) using the methods disclosed herein are greater than 3% (i.e., greater than 3% of the deposition material sprayed onto the substrate is incorporated into the film), or greater than 5, 10, 15, 20, 25, 30, 35, 40, 50, or 75%. In some embodiments, spray efficiencies using the methods disclosed herein are between 5% and 99%, or between 10% and 99%, or between 15% and 95%, or between 20% and 95%, or between 25% and 75%. It will be appreciated that, given a set of conditions (including deposition solution concentration, deposition material identity, deposition layer thickness, etc.), there is a maximum theoretical transfer efficiency. This value is a measure of the amount of deposition material that remains in the deposition layer after a tightly packed monolayer of deposition material has formed on the surface. Regardless of the amount of time that is allowed to elapse, this maximum transfer efficiency cannot be increased because of the self-limiting nature of LbL film formation. In some embodiments, the methods described herein seek to maximize transfer efficiency by reducing the amount of excess deposition material left in the deposition layer after formation of LbL films. In some embodiments, the methods described herein seek to minimize the amount of time needed between deposition and rinse while still allowing complete or near complete formation of tightly packed LbL films.

In the context of transfer efficiency, the ratio of depletion depth to the thickness of the sprayed deposition layer affects the transfer efficiency. All or most of the deposition material that exists outside the depletion depth is likely to be wasted and cause a decrease in transfer efficiency.

It will be appreciated that, if the residual rinse layer is eliminated entirely (e.g., by drying the film after deposition and rinse), non-uniformities in the residual rinse layer may be introduced as it is being eliminated (e.g., due to changes in concentration, surface tension, etc.). These nonuniformities may lead to corresponding nonuniformities in the resulting film. Such nonuniformities (e.g. in layer thickness or packing density) may or may not play a role in the assembly process. Furthermore and without wishing to be bound by theory, it is believed that repetitive drying steps can lead to film failure during the process (e.g. film cracking). Furthermore, without wishing to be bound by theory, eliminating the residual rinse layer entirely may cause scratching of the film, for example, when the film moves over a front-side contact roller.

In some embodiments the depletion depth can be altered by changes in the solution concentration or other changes that affect the diffusivity of the particles in the solution (e.g., MW, size, viscosity, temperature, shape, etc.). In some embodiments the depletion depth is made to be less than 10 μm, or less than 5 μm, or less than 1 μm. In some embodiments, the depletion depth is made to be at least 5, 10, 20, 30, 50, 75, or 90% of the thickness of the spray deposition layer.

In some embodiments, the thickness of the residual rinse layer can be reduced by using the deposition solution to push aside or displace the residual rinse layer. This may, however, require additional deposition solution and may therefore result in lower transfer efficiency.

Without wishing to be bound by theory, it is believed that application of the rinse solution causes dilution of the deposition material. In the same way that applying deposition sprays can thin the residual rinse layer (see above), the activity of spraying the rinse solution serves to dilute the excess material in the combined residual rinse layer and sprayed deposition layer. Thus, even after the application of the rinse solution, there are still some particles and polymer in the residual rinse layer. The excess particles and polymer may cause complexation with material from a subsequent application of deposition solution and create disruptions in the assembly process. Eliminating these excess molecules and particles can be accomplished, for example, by pushing them off of the surface. In some embodiments, this is achieved with the reduction in thickness of the residual rinse layer, such as by application of an airflow, a vacuum, by gravity, by other body forces. In some embodiments, this is achieved with surface tension effects, Marangoni flows, electroosmosis, or electrophoresis. Any combination of these methods may be used as well. In some embodiments, the removal of these excess molecules and particles using the methods described above reduces the volume needed for sufficient dilution during the rinse step. In some embodiments, the removal of these excess molecules and particles using the methods described above eliminates the need for a rinse step.

In some embodiments, the methods of interest involve application of a deposition solution to form a deposition layer on a surface. Such application can be by spray application or otherwise, such as dipping and removing a substrate into and out of a deposition solution. As described herein, the deposition layer can be optionally thinned. Also as described herein, the deposition solution comprises a solvent and a deposition material (e.g., nanoparticles or a polyelectrolyte). Such application creates a deposition layer having a thickness equal to $d_{dep}$, an initial concentration of deposition material equal to $C_B$, and a diffusion coefficient (i.e., of diffusion of the deposition material through the deposition layer solvent) equal to D. Diffusion coefficient D can be determined both experimentally and estimated theoretically (for example using the Stokes-Einstein equation for spherical particles). The deposition layer can be directly disposed on the surface or indirectly disposed on the surface. When indirectly disposed on the surface, a residual rinse layer can be present between the deposition layer and the surface. The surface may be either a surface of a substrate or a surface of a film.

Immediately after application of the deposition solution, deposition material begins diffusing out of the deposition layer and onto the surface (or into a residual rinse layer if one is present and then ultimately onto the surface). This continues until the deposition material forms a saturated monolayer on the surface. The variable $C_s$ represents a "desired surface concentration" (measured as number of particles per area). For example, the $C_s$ value for a saturated (i.e., tightly packed) monolayer is the maximum possible $C_s$ value for monolayers. A lower $C_s$ can be selected for any desired application. For example, after the time of deposition and during the process time, the surface concentration of the deposition material will increase as additional molecules bind to the surface, asymptoting to $C_s$. It will be appreciated that the surface concentration $C_s$ is a measure of the packing density and will be dependent upon a variety of factors such as particle size, zeta potential, etc.

As deposition material diffuses from the deposition layer to the surface, the overall concentration within the deposition layer decreases. Without wishing to be bound by theory, however, it is believed that the deposition layer partitions into a depletion depth and a residual deposition region (defined above). As long as the thickness of the residual deposition region is greater than or equal to the thickness of the depletion depth, the concentration of deposition material within the depletion depth will remains substantially constant (or varies by less than 20%, or less than 10%, or less than 5%, or less than 2%) throughout process time $t_{dep}$. In other words, and again without wishing to be bound by theory, it is believed that replacement deposition material diffuses into the depletion depth from the residual deposition region as deposition material diffuses out of the depletion depth and to the surface. This replacement mechanism keeps the concentration within the depletion depth substantially constant. If the residual deposition region is not as thick as the depletion depth, then once the deposition material in the residual deposition region is exhausted the concentration within the depletion region will begin to decline. In the limit of a deposition layer and depletion depth of equal thickness (i.e., when no residual deposition region is present), the concentration within the depletion depth will decline to zero over process time $t_{dep}$.

Time $t_{dep}$ is the "process time," i.e., the amount of time allowed between application of deposition solution and application of rinse solution. In some embodiments, the process time is the time required for the deposition material to form a saturated (i.e. tightly packed) monolayer on the surface. It will be appreciated that time $t_{dep}$ can be selected based on a variety of factors, such as diffusivity, D, the deposition layer thickness, $d_{dep}$, and the presence and properties (e.g., viscosity and thickness) of a residual rinse layer. For example, $t_{dep}$ may be selected to have a lower value (e.g., less than 10 s, or less than 5 s, etc.) if there is no residual rinse layer or a relatively thin residual rinse layer. In some embodiments, $t_{dep}$ is selected, the deposition solution is applied, and then a period of time equal to $t_{dep}$ is allowed to elapse at which time the rinse solution is applied. At any point during the elapsing process time, the deposition layer may be thinned as described herein. In some embodiments, $t_{dep}$ is equal to $t_{dep\text{-}min}$.

In some embodiments, diffusion constant D may range from $10^{-5}$ cm$^2$/s to $10^{-11}$ cm$^2$/s.

In some embodiments, $C_s$ may range from $10^{19}$ particles/m$^2$ to $10^8$ particles/m$^2$.

In some embodiments, $C_B$ may range from 0.0001 wt % to 50 wt %.

In some embodiments, $t_{dep}$ may range from $10^{-6}$ s to $10^6$ s. For example, $t_{dep}$ may be less than 1 min, or less than 30 s, or less than 15 s, or less than 10 s, or less than 5 s, or less than 3 s, or less than 1 s, or less than 0.1 s, or less than 0.01 s. Also for example, $t_{dep}$ may be between 0.01 s and 60 s, or between 0.1 s and 30 s, or between 1 s and 15 s. In some embodiments, time $t_{dep}$ may be selected to be more or less than the actual experimental time required to create a tightly packed monolayer. When $t_{dep}$ is less than the time required to create a tightly packed monolayer, a monolayer is not formed. Nevertheless, the methods described herein may still be used.

$t_{rinse}$ may range from $10^{-6}$ s to $10^6$ s. For example, $t_{rinse}$ may be less than 1 min, or less than 30 s, or less than 15 s, or less than 10 s, or less than 5 s, or less than 3 s, or less than 1 s, or less than 0.1 s, or less than 0.01 s. Also for example, $t_{rinse}$ may be between 0.01 s and 60 s, or between 0.1 s and 30 s, or between 1 s and 15 s. In some embodiments, time $t_{rinse}$ may be selected to be more or less than the actual experimental time required to allow for the removal of loosely bound or excess film-forming material from the surface. Nevertheless, the methods described herein may still be used. In some embodiments the methods provide for a rapid and high transfer efficiency deposition process for forming a half bilayer for layer-by-layer assembly, the method comprising: (a) forming a layer of deposition solution containing a deposition material on a surface with a thickness ($d_{dep}$), wherein $d_{dep}$ is given by: $C_s/(C_B \cdot \text{eff}) \geq d_{dep} \geq (C_s/C_B)$, (b) maintaining a minimum time ($t_{dep\text{-}min}$) of contact between the deposition solution and the surface, wherein $t_{dep\text{-}min}$ is given by: $t_{dep\text{-}min} \geq C_s^2/(C_B^2 \cdot D)$, wherein $C_s$ is the desired 2-dimensional concentration of deposition material on the surface; $C_B$ is the bulk concentration of deposition material in the deposition solution; $d_{dep}$ is the thickness of the applied layer of deposition solution; the transfer efficiency of deposition material (eff) is greater than 0.03; D is the diffusion coefficient of the deposition material in the deposition solution; minimum wait time $t_{dep\text{-}min}$ is less than 10 seconds; and the thickness of the half bilayer is less than or equal to the thickness of a monolayer of the deposition material.

In some embodiments, the method for forming a half bilayer with speed and transfer efficiency, comprises a desired 2-dimensional concentration of deposition material on the surface ($C_s$) wherein the thickness of the half bilayer is less than or equal to the thickness of a monolayer of the deposition material, the method comprising: (a) applying a deposition solution to a surface to form a deposition layer directly or indirectly disposed on the surface, and optionally thinning the deposition layer, wherein: the deposition layer has thickness $d_{dep}$; the deposition solution comprises a solvent and a deposition material, wherein the concentration of deposition material in the deposition layer is $C_B$; the deposition material has diffusion coefficient D in the deposition layer; and eff is the transfer efficiency of deposition material, a positive number less than 1.0 and greater than 0.03; and (b) allowing a period of time $t_{dep}$ to elapse such that $t_{dep}$ is greater than or equal to $(C_s^2/[C_B^2 \times D])$. The method may further comprise: (c) applying a rinse solution to the deposition layer to form a residual rinse layer and allowing unbound first deposition material to diffuse away from the surface for a period of time $t_{rinse}$, wherein the concentration of unbound first deposition material near the surface decreases; and d) reducing the residual rinse layer thickness. The method may further comprise: the repetition of steps (a-d), using a complementary deposition solutions, with its own $C_s$ $C_B$ eff, D, $t_{rinse}$ and $t_{dep}$) to form a complementary half bilayer, the result of which will be a bilayer. The method may further comprise the repetition of multiple complementary bilayers for the formation of a film.

Apparatus

Also of interest are apparatuses suitable for carrying out the methods and preparing the materials/products described herein.

In some embodiments, the apparatuses of interest are capable of carrying out the methods of interest (i.e., using the materials and methods described herein) on a large scale. For example, in some embodiments, the methods and materials described herein allow large scale, roll-to-roll formation of coatings on substrates. By "large scale" is meant, for example, substrates that are larger than 3 inches, or larger than 6 inches, or larger than 9 inches, or larger than 12 inches, or larger than 18 inches, or larger than 24 inches, or larger than 36 inches in any dimension. In addition to "large scale" by size, "large scale" is also meant to suggest high process throughput. For example, the formation of bilayers occurs at a rate equal to or greater than 100, 500, 1000, 5000, or 10000 square centimeters per minute. Furthermore, by "roll-to-roll" is meant that these methods can be accommodated in a continuous process, coating rolls of substrate of any length.

Solution Application Apparatus

In some embodiments, the apparatus for applying solutions include spray system, flow system, jetting system, dip system, spin system and combinations thereof. In some embodiments, for spray LbL methods of deposition, the apparatuses of interest comprise a plurality of deposition nozzles. The nozzles can be partitioned into a plurality of groups, such as one or more groups designated as deposition solution nozzles and one or more groups designated as rinse solution nozzles. Each group may contain a single nozzle or may contain a plurality of nozzles. Alternatively, a single set of nozzles can have multiple functions, such as delivering deposition solution and rinse solution. In some embodiments, the nozzles are selected from air atomized nozzles, piezoelectrically atomized nozzles, plain orifice nozzles, ultrasonic nozzles, jetting nozzles, other nozzles well known in the art, and combinations thereof. In some embodiments, plain orifice nozzles are used, although such nozzles typically do not provide small droplet sizes (i.e., below 100 microns) as described below. The nozzles may have any spray pattern. In some embodiments, the nozzles have spray patterns that include circular, annular, flat-fan, other spray patterns well known in the art and combinations thereof. In a preferred embodiment, nozzles with flat-fan spray patterns are used. In some embodiments, nozzles create a pattern through the control of the spray angle. For example, a flat fan plain-orifice nozzle may have a 60 degree pattern, a 95 degree pattern, 105 degree pattern, 120 degree pattern or greater. Using a wider angle nozzle enables a greater area of coverage. These patterns are typically created through the design of the orifice of the nozzle, and are well known in the art. The nozzle spray patterns are designed based on a specific operating pressure or a specific range of operating pressures and operating at lower or higher pressures can cause the spray pattern to vary in an uncontrolled manner. It is appreciated that the flat-fan spray patterns are not completely flat. The total area of coverage is, in an idealized environment, determined by the desired spray pattern, the angle of the selected nozzle and the distance between the nozzle and the substrate, and can be calculated through simple trigonometry, well known in the art. In some embodiments, the distance that sprayed droplets travel is between six inches and 24 inches, or between 6 inches and 15 inches, or between 9 inches and 14 inches. By increasing the total area of coverage, for a fixed flow volume through the nozzle, the volume of fluid that contacts the surface per area will decrease. In some embodiments, spray nozzles used for rinse solution are operated at flow rates that are in excess of the flow rates used for applying deposition solution. In some embodiments, nozzles used for rinse solutions are arranged such that the spray droplets impact the surface at the tangent of a roller. In some embodiments, the residual rinse layer or deposition layer is adjusted by decreasing the volume of fluid that contacts the surface per area. In some embodiments the nozzle is actuated. In some embodiments, the nozzles can be oscillated. In some embodiments, the nozzle oscillation may be a rotation. For example a flat fan nozzle may be rotated about an axis orthogonal to the plane formed by the flat-fan spray pattern or may be rotated about an axis created in the plane formed by the flat-fan spray pattern. In some embodiments, this oscillation may be less than 5 degrees, less than 10 degrees, less than 20 degrees, etc. In some embodiments, the nozzle may be actuated in a linear fashion. For example a flat fan nozzle may be actuated in the plane of the flat-fan spray pattern. In some embodiments, the nozzle is oscillated to periodically decrease the spray distance between the nozzle and the substrate. In some embodiments, nozzles are selected to have good flow rate uniformity over the spray pattern. For example, a flat-fan nozzle will demonstrate average flow rates, for example, measured in milliliters per second per square centimeter, that vary less than 25%, or less than 15%, or less than 10%, or less than 5% or less. In some embodiments, the nozzles are selected from manufacturers such as NF type nozzles (BETE), Evenspray nozzles (Spraying Systems), or minispray nozzles (Danfoss HAGO). In some embodiments, nozzles may be selected to deliver low flow rates. In some embodiments, low flow rates through nozzles are achieved by operating nozzles at low pressures. In some embodiments, the flow rates are less than 100, 10, 1, 0.1, or 0.01 gallons of solution per hour per square meter. In some embodiments, the flow rates are less than 1000, 100, 50, 25, 10, or 1 milliliters per square meter. In some embodiments, the nozzles are designed to have shutters, where the shutters control the amount of fluid that exits the nozzle. In some embodiments, the shutters are controlled mechanically, electronically, magnetically, or other mechanisms known in the art. In some embodiments, the shutter operates at very high frequencies or duty cycle. A high frequency or duty cycle allows, for example, lower flow rates and deposition of smaller amounts of deposition solution. An example of such a nozzle system is the pulsejet (Spraying Systems, Inc.). The pulsejet system possesses a solenoid, designed to shutter the nozzle and adjust the flow rate through adjustment of the duty cycle of the solenoid.

In embodiments, the apparatus comprises first and second deposition nozzles configured to deposit fluid such that the average thickness of the deposition layer is less than 20, 10, 5, or 2 microns. For a fixed flow rate of fluid exiting a nozzle (e.g. a fixed ml/sec flow) that covers a certain width of substrate, the average deposition layer thickness is determined by the equation (flow rate/(width of coverage×line speed of substrate)). The line speed of the substrate is the relative speed with which a substrate moves past an apparatus for applying solution, such as past a nozzle.

In embodiments, the size of the droplets exiting the nozzle is controlled. By controlling the size of droplets exiting the nozzle, it is also possible to control the size of droplets that impact the surface and therefore to control the size and coverage of solution on the surface resulting from each droplet impact. Assuming that droplets impact the surface in a random fashion, smaller drop sizes emitted by the nozzles allows high uniformity with high transfer efficiency. Without wishing to be bound by theory smaller droplets impacting the surface provide for smaller lateral distance between impacted droplets, enabling more rapid lateral diffusion for complete surface coverage. Larger droplet sizes can still obtain high uniformity but reduces the material efficiency compared with smaller droplets and/or requires longer diffusion times for complete surface coverage. This is because, with larger drop size, obtaining uniform coverage requires significant overlapping of droplets reaching the surface. Ideal droplet size such as those that can be obtained with the methods described herein are "small," meaning less than or equal to 100, 80, 60, 40, 30, 20, or 10 microns, such as in the range 5-100, 10-50, 10-40, or 10-30 microns. Small droplets are preferred because they enable uniformity of the coating on the substrate while providing high efficiency (small droplet size means that there is minimal distance needed for coating material to diffuse through solution to reach the substrate surface and to achieve sufficient droplet overlap. Small diffusion distances also allow for rapid coatings and therefore high line speed. Droplet size can be controlled by nozzle orifice shape and/or size, operating conditions (e.g. flow rate, pressure, piezo frequency, and the like), solution properties (e.g. viscosity, surface tension, density, and the like) and/or methods of actuation (e.g. inkjet delivery, ultrasonic delivery, air atomization, fluid jetting, and the like).

Thus, in embodiments, the apparatus of the invention comprises one or more nozzles configured to provide small droplet sizes as described herein. Such configuration provides for high efficiency at high line speed and high uniformity. For example, high efficiency includes transfer efficiencies greater than 5, or 10, or 15, or 20, or 25, or 30, or 40, or 50%. For example high line speeds are greater than 5 m/min, or 10 m/min, or 15 m/min, or 25 m/min or 50 m/min, or greater.

In some embodiments a plurality of nozzles are used. In some embodiments the plurality of nozzles are "tiled"—i.e., the nozzles are arranged in such away such that nozzles provide overlapping spray patterns, to deliver sufficient fluids to the surface. For example a flat-fan plain-orifice nozzle that is positioned to span across 12 inches of a substrate, 3 or more nozzles could be tiled to provide sufficient coverage over a 36 inch wide substrate. In some embodiments tiled nozzles are such that the regions of overlapping spray patterns exhibit a higher flow rate per unit area than in the areas of the spray pattern that are not overlapping. In some embodiments, the nozzles are "canted", where "canted" refers to a rotation about the axis of the nozzle such that the regions of overlapping spray patterns do not physically interfere. In the context of the deposition of solutions in the layer by layer process, uniformity is achieved through delivering sufficient solution to ensure that the self limited assembly process is driven to completion. As a result, any additional solution volume which is applied in excess of what is required to achieve completion of the assembly process, does not lead to any additional growth and spray patterns can be arranged such that sufficient solution arrives at the surface at every location. In some embodiments, tiled nozzles spray the same solution. In some embodiments, tiled nozzles are connected together such that there is fluid communication between them. In some embodiments, the fluid communication is a low fluid pressure pipe. In some embodiments, the tiled nozzles, connected together with the pipe form a "spray bar". In some embodiments, the spray bar is connected to a source of solution or rinse. In some embodiments the solution is forced through the spray bar and through the individual nozzles. In some embodiments, the mechanism of forcing is pressure, gravity, pumping, or other techniques known in the art. In some embodiments, the solution is continuously forced through the spray bar. In some embodiments, the assembly of tiled nozzles is arranged such that a uniform distance between tiled nozzles is maintained. In some embodiments, pluralities of spray bars are used. In some embodiments, spray bars are used for spraying deposition solutions or rinse solutions. In some embodiments two or more spray bars are arranged in between spray bars configured for applying deposition solutions. This is referred to as a dual or multi stage rinse, where there is sufficient time, $t_{rinse2}$, $t_{rinse3}$ or additional $t_{rinse}$, is allowed to elapse prior to the presence of the next stage rinse. In some embodiments, two or more spray bars are used for a deposition step. This is referred to as dual or multi stage deposition. In an embodiment, the spray bar of the apparatus is a low-flow spray bar. The low-flow spray bar comprises a plurality of nozzles wherein the nozzles are holes that have been drilled into a tube, thereby making a perforated tube. This perforated tube may be manufactured by using laser drilling (or other drilling) to perforate a tube with one or multiple rows of holes with small diameters (e.g.: 0.0022 inches, or in the range 0.0001-0.003, or 0.0012-0.0025 inches). The low-flow spray bar can be used for deposition solution or rinse solution. In embodiments, the desired liquid is injected via an orifice from one side, both sides, or any other orifice into the tube and exits as streams or mists of fluid out of the drilled holes. The tube diameter is selected appropriately to control the flow rate of fluid out of the perforations, allowing for control of fluid flow rates during deposition and rinse. In embodiments, the low-flow spray bar is suitable to deliver relatively lower $d_{dep}$ (or deposition layer thickness) or $d_{rinse}$ (residual rinse layer thickness), particularly where the holes are laser drilled and are of smaller diameter as mentioned above. Additionally the force with which the streams exit the drilled holes can be controlled to mitigate rinse erosion (i.e., erosion of molecules of the surface or surface layers due to impact from the sprayed solution). In embodiments the low-flow spray bar is relatively (compared with other nozzles) more directional and prevents fluid from reaching the back side of the substrate and eliminates overall efficiency losses due to more droplets impact the surface to form the deposition layer.

In some embodiments, the apparatuses of interest include a plurality of nozzles for applying additional solvent or other materials to the residual rinse solution. In some embodiments the additional solvent is isopropanol, ethanol, etc. For example, such additional solvent can be used to lower the surface tension of the residual rinse layer, thereby increasing evaporation and reducing the residual rinse layer thickness.

In some embodiments, alternatives to pressure actuated nozzles are used, such as ultrasonic atomizers with airflow directors, inkjet nozzles, air shroud directed turbine sprayers or electrostatic air atomizer sprayers. A suitable ultrasonic atomizer is produced by Sono-Tek, suitable inkjet nozzles are produced by Fujifilm Dimatix or Agfa, a suitable air shroud directed turbine sprayer is produced by Nanobell and a suitable electrostatic air atomizer spray system is produced by Microbicide. In an embodiment, the apparatus comprises inkjet nozzles. The inkjet nozzles, when configured to provide small droplet sizes (i.e., less than 100, 80, 60, 40, 30, 20, or 10 microns as mentioned above), allow for control over the placement of drops to within a lateral position of less than or equal to 100, 80, 60, 40, 30, or 20 microns. Such control enables high efficiency and high uniformity coverage. A suitable inkjet nozzle for carrying out such control is the SAMBA nozzle, produced by FUJIFILM®. In an embodiment, the SAMBA nozzle allows for 20-25 micron drop sizes and enables drop placement with 20 micron spacing on the substrate. This configuration therefore allows for perfect or nearly perfect coverage of the substrate with a single layer of droplets.

Material Handling and Fluid/Surface Control

In some embodiments, the apparatuses of interest include means for handling the substrate. Such means will depend upon the type or types of substrate that is/are to be handled. Certain means for substrate handling includes contact rollers for roll-to-roll webhandling, actuators, robotic arms, and the like. In some embodiments the means for handling the substrate are entirely robotic. In some embodiments, the means for handling the substrate may be entirely or partially automated. Contact rollers may be configured to contact the deposition side of the substrate, the non-deposition side of the substrate, or both sides of the substrate. In some embodiments, the means for handling a substrate, involves translating a surface past spray bars.

In some embodiments, the apparatuses of interest include means for decreasing a deposition layer thickness, and/or a means for decreasing a rinse layer thickness. In some embodiments a single means for decreasing a layer thickness can function to decrease both deposition and rinse layer thicknesses. As examples, contact rollers, vacuum attachments, and air knives may be used to decrease deposition and/or rinse layer thicknesses. The deposition and/or rinse nozzles themselves may also be used to decrease deposition and/or rinse layer thicknesses, as described above.

In some embodiments, the vacuum attachments comprise a vacuum bar. A vacuum bar is a mechanical device that is connected to a vacuum source. The vacuum bar may be disposed in close proximity to the residual rinse or deposition layer such that when the vacuum source is activated, fluid is drawn from the residual rinse or deposition layer, effecting a decrease in the thickness. In some embodiments, the vacuum bar comprises a cavity disposed within an elongated tube, an opening disposed in the wall of the tube, and an interface for a source of vacuum. In embodiments the tube is stainless steel or another appropriate material and has a diameter (i.e., greatest cross-sectional dimension) between 5-500, 5-100, 10-70, or 10-50 mm. In embodiments the cross-section of the tube is circular or square. The length of the tube can be any appropriate value but in embodiments is equivalent to or greater than the width of the substrate (e.g., for a 1 m wide substrate, a vacuum bar that is at least 1 m, such as 1, 1.1, 1.2, or 1.3 m long is suitable). For example the length may be 10-250, 10-210, 20-150, or 30-100 cm. In some embodiments the opening is a linear opening that runs for the length of the tube or that runs for a percentage (e.g. 50, 60, 70, 80, or 90%) of the length of the tube. In embodiments the length of the opening is equal to the width of the substrate surface to be coated. In some embodiments, the length of the opening spans greater than the width of the surface, such as 5, 10, 20, 30, or 40% greater, or may span less than the width of surface, such as 5, 10, 20, 30, or 40% lesser. In some embodiments, the width (gap) of the opening is less than 100, 10, 5 or 1 mm, or less than 500, 100, 50, or 25 microns. In some embodiments, a vacuum bar operates at vacuums of greater than 2, 5, 10, or 15 inches of water column. In some embodiments, the vacuum bar operates at vacuum between 5 inches and 20 inches of water column, or between 5 inches and 15 inches of water column. In some embodiments, the vacuum bar is disposed close to the surface. In some embodiments the vacuum bar is positioned less than 20, 15, 10, or 5 mils from the fluid surface. In some embodiments the vacuum bar is located directly below the surface. In some embodiments the vacuum bar is disposed such that the opening of the vacuum bar is directly beneath a roller. In embodiments, the vacuum bar is maintained as close as possible to an adjacent roller. Also in embodiments, the vacuum bar is operated at maximum practical velocity (wherein "velocity" refers to the speed of material entering the opening of the vacuum bar due to vacuum being applied) to maintain strong liquid removal. With the foregoing in mind, in embodiments, the vacuum bar is designed and configured to minimize "suck up", i.e., the condition wherein vacuum from the vacuum bar is sufficient to cause deflection of the vacuum bar and/or deflection of an adjacent roller, such that the vacuum bar contacts the adjacent roller. In embodiments, the circular cross-section of the vacuum bar is modified such that the distance between the roller and the nearest point of the vacuum bar remain equal, such as when a semicircular notch is cut out of the cross-section of the bar and then the roller is configured to be disposed within the semicircular notch (but not contacting the vacuum bar). In other embodiments, the circular cross-section of the vacuum bar is modified such that the distance between the roller and the nearest point of the vacuum bar is not equal, such as when a semicircular notch is cut out of the cross-section of the bar and then the edges of the notch are removed to create flat portions. In embodiments, the opening of the vacuum bar is disposed within a semicircular notch that is cut out of the cross-section of the vacuum bar. In embodiments, the semicircular notch is further modified to remove sharp edges where the notch meets the larger cross-section of the vacuum bar. Thus in an embodiment the cross-section of the vacuum bar is square with a notch cut into one side of the vacuum bar. In an embodiment the cross-section of the vacuum bar is primarily circular with one flattened edge, and with a notch cut into the one flattened edge of the vacuum bar. In these embodiments, the opening is disposed within the notch.

In some embodiments, the apparatuses of interest comprise one or more contact rollers positioned to be in close proximity to the point of contact between the deposition solution and the surface. That is, the one or more contact roller acts as a spreader to smooth out deposition solution or rinse solution on the surface, thereby reducing areal variation in layer thickness. For example, where the deposition layer or rinse layer is sufficiently thin that it forms droplets on the surface (i.e., pooling or beading), the contact roller can be employed to smooth the solution on the surface and form a uniform layer. In some embodiments, at least one of the one or more contact rollers has a surface finish with RMS roughness of less than 5 μm, or less than 1 μm. In some embodiments, contact wipers are disposed next to the roller such that excess material that is left on the roller can be removed or cleaned from the roller. In some embodiments, contact wipers are made of a soft material, such as rubber. In some embodiments, the wiper can be actuated such that there is no physical contact between the wiper and roller at desired times.

Control Systems

In some embodiments, the apparatuses of interest include control systems for substrate movement (e.g., speed, etc.). In some embodiments this includes methods for controlling web tension, steering, tendency driving, and other web-handling methods known in the art. In some embodiments, apparatuses of interest include control systems for the environment (temperature, pressure, humidity, etc.), well known to a practitioner in the art. In some embodiments, the apparatuses of interest include methods to measure the thickness of the residual rinse layer or deposition layer. In some embodiments the method to measure residual rinse or deposition layer thickness includes spectral reflectance. In some embodiments a Filmetrics F-10 or F-20 (Filmetrics) systems can be used to measure residual rinse layer thickness.

Ventilation

In some embodiments, the apparatuses of interest include means for ventilating the apparatus. In some embodiments, the apparatus provides for ventilation in a downdraft manner. In some embodiments, the ventilation flow rate is maintained such that minimal deposition spray droplets are ventilated prior to contact with the substrate. In some embodiments, the amount of deposition spray droplets that is ventilated prior to contact with the substrate is less than 50%, less than 20%, less than 10%, less than 5%. In some embodiments, ventilation is confined to regions close to the deposition area. For example a spray bar may be located in the ventilation box. In some embodiments, ventilation boxes are used to control ventilation to a specific region. In some embodiments, the ventilation box resembles a container with an opening. The container may be a 5-sided box. The opening allows for sprayed droplets to contact the surface, which is disposed next to the opening. In some embodiments, there are two or more ports in the ventilation box for communication with a vacuum system. In some embodiments, the vacuum is operated such that air flow velocities in the gaps are less than 500, 100, or 50 linear feet per minute.

Waste Handling

In some embodiments, the apparatuses of interest include means for removing or recycling liquid waste. Such means are well known in LbL deposition and include vacuum systems, drainage systems, and the like.

Deposition System

Figure 4:
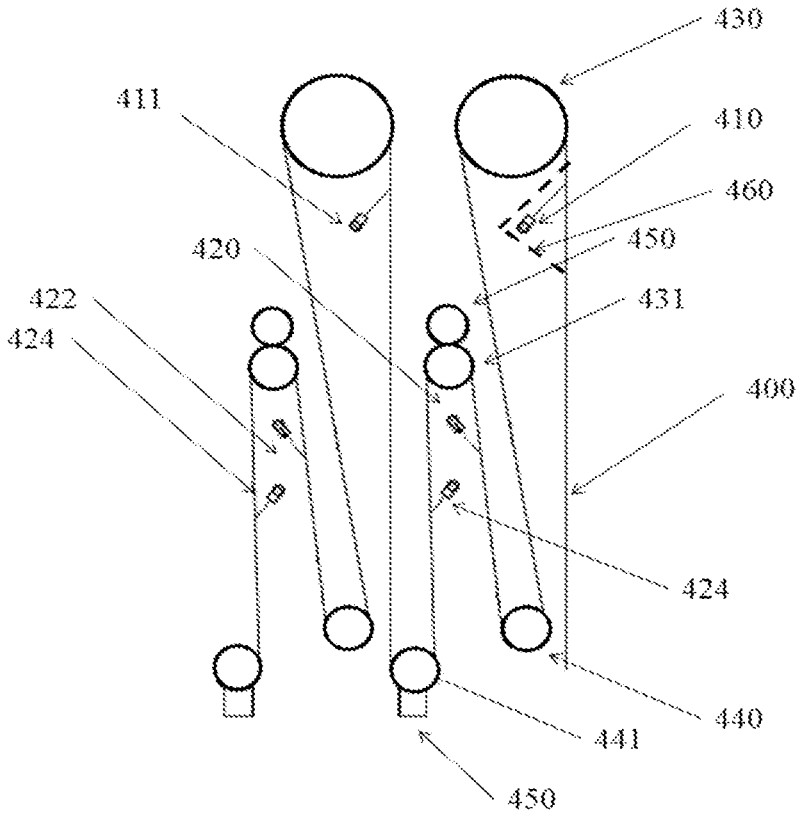
FIG. 4 provides a schematic representation of a bilayer deposition module.
Figure 5:
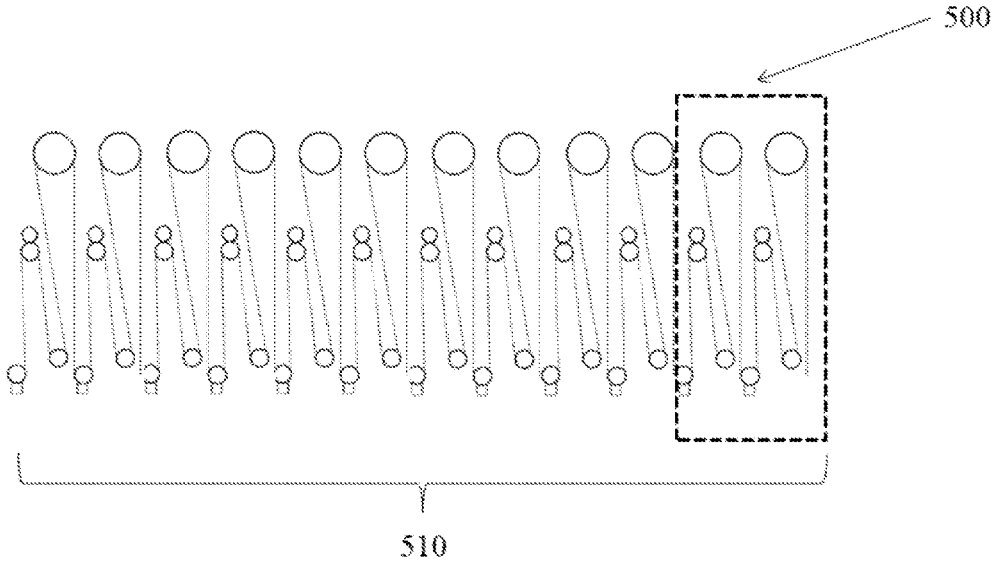
FIG. 5 provides a schematic representation of system comprising a plurality of bilayer deposition modules.

In some embodiments the abovementioned apparatus are arranged into a system for large scale layer by layer deposition. In some embodiments system comprises a plurality of nozzles, organized into spray bars. In some embodiments the system comprises a means for handling a substrate, for example in a roll to roll fashion. In some embodiments, the system comprises a means for ventilation. In some embodiments, the system comprises a means for waste handling. In some embodiments the system comprises a means for controlling the system. In some embodiments, a system is arranged into a self-contained deposition module. In some embodiments the deposition module comprises a series of rollers that are arranged such that the surface moves past a ventilation box containing a spray bar for applying deposition solution. In some embodiments, the deposition modules further comprises a front-side contact roller which makes contact with the surface with the deposition solution. In some embodiments, the deposition module further comprises a ventilation box containing a spray bar for applying rinse solution. In some embodiments, the deposition module further comprises a back-side contact roller. In some embodiments, the deposition module further comprises a ventilation box containing a spray bar for applying a second stage rinse solution. In some embodiments the deposition module further comprises a second front-side contact roller. In some embodiments, the deposition module further comprises a second back-side contact roller with an apparatus for residual rinse removal. In some embodiments, this apparatus for residual rinse removal is a vacuum bar. FIG. 4. shows a cross sectional schematic of an embodiment of the bilayer deposition module apparatus. Substrate 400 is a flexible material. A plurality of nozzles 410 apply deposition solution to the surface of substrate 400. Ventilation box 460 is used to contain deposition solution and may be connected to source for providing air flow. The substrate surface is translated past front side contact roller 430 which serves as a means for moving the surface of substrate 400 and simultaneously as a means for smoothing or thinning the deposition layer. Substrate 400 moves past back side contact roller 440 before having rinse solution applied by plurality of nozzles 420. The residual rinse on the surface of substrate 400 is decreased by the front-side contact roller 431 and the nip roller 450. The surface of substrate 400 is then translated past a plurality of second-stage rinse nozzles 424. The surface of substrate 400 then is translated past a back-side contact roller 441 with residual rinse removed by the vacuum bar attachment 450. The surface of substrate 400 then moves past a plurality of nozzles 411 which apply another deposition solution and a plurality of nozzles 422 and 424 for the first and second stage rinse. In some embodiments a system comprises a plurality of deposition modules intended to be disposed one after another such that multiple deposition solutions and rinse solutions can be applied inline. FIG. 5 shows a cross sectional schematic of an embodiment of the system. Bilayer deposition module 500 is connected to a series of bilayer deposition modules to form a system 510. In some embodiments, the spray bars in the multiple inline deposition modules are arranged such that nozzles from one deposition module is intentionally misaligned, compared with the neighboring deposition modules. In some embodiments, the misalignment is on the order of 3 centimeters. In some embodiments a system comprises other apparatuses, including, heaters, dryers, UV curers, plasma treatments, unwind, rewind systems, and other coating processes, well known to the practitioners of the art. While this discussion is relevant to an apparatus handling a flexible substrate, practitioners in the art will readily see how this is translatable to alternative substrates including rigid substrates such as glass, or plastic sheets, or metals.

Examples of Features of the Coatings

In some embodiments, the methods and materials described herein provide coatings that are made of a plurality of bilayers. Each bilayer contains a pair of materials that participate in complementary bonding interactions.

In some embodiments, the coatings prepared herein are highly uniform. In the context of the coatings of interest, the term "uniform" may have a variety of meanings. For example, in some embodiments, the variation in coating thickness across the entire film is very small. Also for example, in some embodiments, the coating growth rates are uniform and predictable during preparation. Also for example, in some embodiments, the process window is wide, where the growth rate may be consistent despite the presence local variation in deposition solution conditions. Also for example, in some embodiments, the bilayer interfacial regions are sharp, non-rough, and/or consistent in composition.

For example, the variation in overall coating thickness is less than 5%, or less than 3%, or less than 1.5%, or less than 1% across the coating, or across any portion of the coating.

For example, the coating growth rate is uniform and varies by less than 20%, or less than 10%, or less than 5%, or less than 3%, or less than 1% throughout the coating process. This means, for example, that the bilayers applied at the beginning of the coating process (i.e. closer to the substrate surface) have the same or similar thickness as the bilayers that are applied near the end of the coating process (i.e. further from the substrate surface).

In some embodiments, the methods and materials described herein provide control over properties of the interface between bilayers.

For example, the thickness, sharpness, and composition of the interface can be controlled. By such control, the refractive index profile (i.e. refractive index as a function of position) within the coating can be controlled as desired.

In some embodiments, the methods and materials described herein provide coatings that contain a plurality of tightly packed nanoparticle layers. In some embodiments, the monolayer is tightly packed such that interdiffusion between layers (i.e. diffusion of the nanoparticles of one layer diffusing into an adjacent layer) is minimized.

In some embodiments, the methods and materials described herein provide the coatings described herein without the need to heat the coatings above a predetermined temperature and/or without the need to subject the coatings to elevated pressures. Such predetermined temperature may be room temperature, or above room temperature (e.g. 50° C. or 100° C.). The predetermined temperature may be the calcination temperature of the coating (i.e. the temperature at which a volatile fraction is removed from the coating). The predetermined temperature may be the sintering or fusing temperature of one of the materials in the coating. In some embodiments the predetermined temperature and pressure are those required to hydrothermally fuse the material forming the coating.

In some embodiments, the methods and materials described herein provide coatings prepared by LbL spray deposition, wherein the methods are streamlined and simplified (e.g. utilizing fewer solutions, eliminating thermal treatment steps, etc.) compared with previous LbL methods.

In some embodiments, the methods and materials described herein provide the ability to create complex optical coatings with behavior consistent with optical modeling. Examples of optical coatings include dichroic mirrors and filters, anti-reflection coatings, and Fabry-Perot etalons.

In some embodiments, the methods and materials described herein provide the ability to create low haze optical coatings.

In some embodiments, the methods and materials described herein provide the ability to create multilayer photonic interference structures.

In some embodiments, the methods, apparatuses and materials described herein provide for higher and/or more efficient material utilization.

In some embodiments, the methods, apparatus and materials described herein provide for faster deposition processes.

In some embodiments, the methods, apparatus and materials described herein provide for higher uniformity in the resulting coatings.

In some embodiments, the methods, apparatus and materials described provide for simultaneously high efficiency, uniformity and throughput.

It is to be understood that while the invention has been described in conjunction with examples of specific embodiments thereof, that the foregoing description and the examples that follow are intended to illustrate and not limit the scope of the invention. It will be understood by those skilled in the art that various changes may be made and equivalents may be substituted without departing from the scope of the invention, and further that other aspects, advantages and modifications will be apparent to those skilled in the art to which the invention pertains. The pertinent parts of all publications mentioned herein are incorporated by reference.

EXPERIMENTAL

Example 1

Preparing Coatings

Polymer: 0.356 g of 20 wt % 100 k-200 k molecular weight poly(diallyl dimethyl ammonium chloride) or PDAC, available from Sigma Aldrich, was added to deionized water with a final volume of 1 liter and mixed at 500 rpm for 30 minutes. Sodium hydroxide was added to the mixture until a pH measurement of 10.45 was achieved.

Silica: 150 g of Ludox TM-50 (22 nm diameter particles, confirmed using dynamic light scattering) varying amounts of sodium chloride and 3 g of $Na_2O$ (all obtained from Sigma-Aldrich) were mixed with 7.5 liters of deionized water and mixed at 500 rpm for 30 minutes. Sodium chloride was added to achieve a specific molarity. Lastly, sodium hydroxide was added to the mixture until a pH measurement of 11.75 was achieved.

Rinse: Sodium hydroxide was added to deionized water until a pH of 10 was achieved.

These solutions were used in the Examples below as indicated.

Example 2

Deposition of Solutions

2"×2" borosilicate glass plates (obtained from McMaster-Carr) were used as substrates. A LbL spray deposition apparatus (modeled after the apparatuses described in US Patent Application Publication No. US 2010/0003499 to Krogman et al., as well as Krogman et al., *Automated Process for Improved Uniformity and Versatility of Layer-by-Layer Deposition, Langmuir* 2007, 23, 3137-3141) was used to apply solutions directly to substrates. For films of silica, solutions of polymer (4 s spray time) and silica (4 s spray time) were alternated with rinse (10 s spray time) applied in between. For films of buffered silica, solutions of polymer (4 s spray time) and buffered silica (4 s spray time) were alternated with rinse (10 s spray time) applied in between. 50 bilayers were generated for each film, with cycles of polymer-rinse-silica-rinse or polymer-rinse-buffered silica-rinse resulting in a single bilayer.

Example 3

Film Properties and Measurement

Experimental results were obtained using an F-10 contact UV-Vis reflectance spectrophotometer (FILMETRICS®).

Measurements were obtained systematically across the width of the substrate at quarter inch increments. Using the optical modeling package (TFCalc), results for refractive indices and film thickness could be calculated. Refractive indices for the results were 1.26+/−0.02. Film thickness measurements at multiple points across a film are shown in FIG. 3*a* for different solution conditions.

Average film thickness increased from 815 nm, with total variation in thickness from 803-829 nm, to 855 nm, with total variation in thickness from 842 nm-869 nm, an increase of about 5%, when sodium chloride concentrations in the nanoparticle solutions was increased from 0.03M to 0.04M. The observed increase in average film thickness with increased salt concentration suggests that the increased salt-induced shielding effect of electrostatic repulsion between neighboring silica nanoparticles allows more dense packing. This suggests that at 0.03M NaCl, the films are made of bilayers containing nanoparticles that are not tightly packed, or as tightly packed, as compared to higher salt concentrations. Furthermore, significant variation in thickness across the film, with large total variation in the thickness of the film across a small substrate, shows that at less than optimal dense packing, there is the possibility of decreased uniformity resulting from a greater sensitivity to process conditions.

Increasing sodium chloride concentration to 0.045M increases the average film thickness to 900 nm and the total variation in film thickness of 897 nm-902 nm. The theoretical packing density for monodisperse three dimensional hexagonally packed spheres suggests that for a tightly packed arrangement in the limit of large numbers of layers of spheres (for example, greater than 10) has an effective growth rate of 0.81*d, where d is the diameter of the sphere. At 0.045M NaCl, the film growth rate is 900 nm/50 bilayers=18.0 nm. The theoretical growth rate based on d=22 nm as specified by Ludox TM-50 is 0.81*(22 nm)=17.8 nm. This small variation can be explained as experimental error or the presence of the polymer, which could contribute 2-3 angstroms of additional thickness to the film. Therefore, the measured thickness of the film corresponds to 0.81*d, indicating a tightly packed surface. With the presence of the tightly packed monolayer of nanoparticles the sensitivity to process variation is mitigated, leading to a much more uniform film.

With data not shown here, an experiment varying PDAC concentration (operating above the theoretical limit for full surface coverage) exhibits minimal effect on the film thickness and corresponding growth rate. A tenfold increase in PDAC concentration changes the growth rate by <1%.

As sodium chloride concentration is increased to 0.06M, the average thickness remains at 900 nm with comparable uniformity to measurements taken at 0.045M. At 0.06M, the film is still tightly packed, yielding highly uniform films with controlled growth rates that can be correlated to theory (i.e., growth rates that are proportional to the diameter of the nanoparticles). This provides an operating window where robust, tightly packed, uniform, controlled growth is observed, even though some variation in process conditions (i.e. salt concentration) may exist. Setting an operating condition between 0.045M and 0.06M would enable small experimental errors in nanoparticle solution preparation or process related changes in salt concentration (local evaporation) to have a minimal impact on the deposition process and corresponding final film thickness.

As sodium chloride concentrations are further increased to 0.07M, the average film thickness increases to 922 nm with a total variation in thickness of 900 nm-942 nm. At this concentration, electrostatic interactions are shielded beyond the limit of stability and individual nanoparticles begin to agglomerate. This manifests as both an increase in the average thickness as well as sensitivity to process conditions which can lead to non uniformity across the film. Further increasing the sodium chloride concentration to 0.1M leads to an average thickness of over 1000 nm with variation in thickness of greater than 50 total nanometers. Increasing the sodium chloride concentration further exacerbates these two defect mechanisms: growth rates greater than the diameter of the nanoparticle and the presence of large non-uniformities.

Example 4

Low Sodium Film Properties and Measurement

A solution of polydiallyldimethyl ammonium chloride (PDACv2) was prepared by adding 16.17 grams of 100-200 k MW 20 wt % solution (Sigma Aldrich) to one liter of deionized water. Tetraethyl ammonium hydroxide (TEAOH, Sigma Aldrich) was added to the solution until a pH of 10.0 was achieved.

Anionic silica nanoparticles (Ludox AS40) were purchased from Sigma Aldrich. 9.2 grams of tetraethylammoniumchloride (TEACL, Sigma Aldrich) were added to one liter of deionized water and mixed until thoroughly dissolved. 25 grams of the nanoparticle suspension were then added to suspension slowly.

Anionic titania nanoparticles (TitanPE X500) were obtained from TitanPE Tetraethyl ammonium hydroxide was added to 1000 grams of X500 solution until a pH of 12.0 was achieved. 9.2 g of TEACL was added to 10 mL of deionized water in a scintillation vial and agitated until TEACL is fully dissolved. TEACL solution was added dropwise to the X500 solution spinning at 500 rpm.

A rinse solution was prepared by adding tetramethylammonium hydroxide (TMAOH) to deionized water to a final pH of 10.0.

2"×2" borosilicate glass (obtained from McMaster-Carr) was used as the substrates. A deposition system similar to those described previously in U.S. Patent Application Publication Number US20060234032 by Krogman and in "Automated Process for Improved Uniformity and Versatility of Layer-by-Layer Deposition," Krogman et al, *Langmuir* 2007, 23, 3137-3141 was used to apply solutions directly to substrates. A deposition solution consisting of PDACv2 and either X500 or AS40 (4 s spray time) was alternated with rinse (10 s spray time) applied in between. 50 bilayers of (PDACv2/X500) of "high index films" and (PDAC/AS40) or "low index films" were deposited for the determination of optical thicknesses and refractive indices.

11-film quarter wave stacks were created from alternating films of high and low index. Each high index film consisted of 11 bilayers and each low index film consisted of 9 bilayers. High index films were numbered 1, 3, 5, 7, 9 and 11 (where film 1 is closest to the substrate and film 7 is furthest from the substrate) and low index films were numbered 2, 4, 6, 8 and 10.

The stacks were removed from the substrate via mechanical scraping with a razor blade. SEM imaging samples were made by mixing the resultant powder and an adhesive and allowed to cure. The samples were then imaged using SEM with representative images.

SEM images show a dense packing of nanoparticles on the surface of these films. SEM images of the cross sections of the multilayer stacks illustrate the resulting precision and uniformity of the thickness over the entire stack as well as for each individual film, 5 micron image viewing area.

A 50 bilayer was deposited using PDACv2 and Ludox AS40 and an apparatus of Example 2. The film thickness was measured using the methods described in Example 3. The resulting measured growth rate was 15.8 nm per bilayer.

Example 5

Spray and Process Efficiency

Table 2 provides calculation results, based on the two-dimensional transport model described in part herein, indicating the effect of concentration on the depletion depth. The calculations assume 17 nm $TiO_2$ nanoparticle, and a 1 cps solution. The corresponding effect of the residual rinse is shown, and the calculations provide a minimum process time (i.e. the minimum amount of time required between deposition and rinse to reach the self-limited tightly packed monolayer).

As an example, a sprayed deposition layer of about 170 microns is provided by a 0.5 second spray, providing 0.17 ml of solution (flow rates are based on an experimental measurement of flow rate from the spray system described herein). For these parameters, given a 1 g/l nanoparticle solution, a process time (i.e., the minimum time required between application of the deposition solution and application of the rinse solution, or the time required to obtain monolayer packing) of 72 seconds is obtained if there is no residual rinse layer and a process time of 123 seconds is obtained if there is a 30 micron residual rinse layer. These are the process times required to obtain monolayer packing, and thus the process times severely impacts throughput. Furthermore, the highest efficiency that can be obtained under this scenario is 43/170 μm or about 25%. In contrast, given a 10 g/L nanoparticle solution, a process time of 0.7 seconds is obtained for complete packing. The corresponding transfer efficiency is 4.3/170 or 2.5%.

TABLE 2

The effect of different solution parameters on process parameters

| [nanoparticle] (g/L) | Depletion Depth (μ) | Residual Rinse (μ) | Required time between Dep and Rinse (s) |
|---|---|---|---|
| 10 | 4.3 | 0 | 0.7 |
| 10 | 4.3 | 30 | 5.8 |
| 5 | 8.6 | 0 | 2.9 |
| 5 | 8.6 | 30 | 13 |
| 1 | 43 | 0 | 72 |
| 1 | 43 | 30 | 123 |

Example 6

Correspondence Between Theory and Experiment

Anionic titania films (PDACv2 and anionic titania particles SvTiO2) were assembled using the methods described herein and utilized as an experimental comparison for the theoretical model.

SvTiO2 particles (diameter around 12 nm measured from TEM micrographs, not show here) were diluted from a stock concentration of about 9.8 g/L keeping the pH constant at 11.2 and salt concentration fixed at 65 mM TEACl. $TiO_2$ concentration was varied from about 0.5 g/L to about 10 g/L. PDACv2 concentration was fixed and present in excess as defined by the model. The plateau in growth rate (approximately 0.81 of the diameter of the nanoparticle) represents the self-limited tightly packed monolayer. The experimental conditions were 0.5 seconds of nanoparticle deposition or 4 seconds of polymer deposition, 4 seconds of wait time, 10 seconds of rinse, followed by thinning of the residual rinse solution with application of air via an air knife. The experimental results correspond very well to the theoretical prediction based on the model. At low concentrations of 0.5 g/L of $TiO_2$ nanoparticles, the growth rate was approximately 2.8 nm per bilayer. The theoretical prediction was 2.2 nm per bilayer. Increasing the concentration to 1 g/L of $TiO_2$ nanoparticles, the growth rate increased to 4.6 nm per bilayer with a modeled prediction of 4.2 nm per bilayer. At 3 g/L of $TiO_2$ nanoparticles, the growth rate began to plateau at 9.8 nm per bilayer where the model predicted 8.4 nm per bilayer. Continued increase of concentration of $TiO_2$ nanoparticles to 6, 8 and 10 g/L, resulted in growth rates of 9.8 nm, 9.7 nm and 9.8 nm per bilayer respectively with model predictions of 9.5 nm per bilayer, 9.8 nm, 9.7 nm per bilayer respectively. The model assumed 12 nm titania nanoparticles, temperature of 27 degrees C., 1 centipoise viscosity, 20 nanometer residual rinse, and 170 microns of sprayed depth. The depletion depth was defined by the specified concentration. For example the depletion depth decreases for increased concentration. The assumed time between deposition and rinse was 4.5 seconds, pegged to the sum of the experimental deposition and wait time. For concentrations of 3 g/l or less, the data and model indicate that in the 4 seconds allotted between rinse and deposition, there is an insufficient number of nanoparticles capable of diffusing to the surface or film (i.e. the depletion depth is not fully depleted). For concentrations greater than 3 g/L, 4 seconds is a sufficient amount of time to allow all nanoparticles in the depletion depth to access the film or surface.

Example 7

Demonstration of Ultra High Spray Efficiency of $SiO_2$ Nanoparticles

Solutions from Example 3 were used to assemble 50 bilayers of [PDAC/SiO2] films. 2"×2" borosilicate glass plates (obtained from McMaster-Carr) were used as substrates. The apparatus of Example 2 was used to apply rinse solution, but deposition solutions were applied using plastic hand misters (CVS Pharmacy). The hand misters were determined to apply approximately 6 microliters of solution per spray application. Under the assumption that 100% of the solution was uniformly applied to the substrate, the estimated deposition layer thickness was 9 microns. The solution was allowed to be in contact with the substrate for 6 seconds before the 10 second rinse was applied. Film thickness was measured and determined to be 885 nm, consistent with the plateau experiments of Example 3. Because the hand misters applied significantly less solution compared with the experiments of Example 3, and maintained a similar film thickness, the efficiency of utilization of the silica nanoparticles increased dramatically. Based on theoretical calculations, under these conditions, the hand misters enabled a transfer efficiency of approximately 25%. Subsequent experiments using decreased concentrations of silica nanoparticles at 50%, 40%, and 20% of the base case lead to film thicknesses corresponding to 902 nm, 895 nm and 720 nm, as measured using modeled reflectometry and profilometry. For 60% and 40% concentration of nanoparticles, the equilibrium film thickness was consistent with the full film thickness indicating higher theoretical transfer efficiency, up to 42% and 62% respectively, while maintaining controlled growth. At 20% concentration, the significant decrease in film thickness accompanies a better theoretical utilization of nanoparticles (up to 97%), but the loss of film thickness corresponds to insufficient coverage of the substrate with the particles. Furthermore this is likely exacerbated due to the assumed large droplet size originating from the hand misters. Operating at a high efficiency while maintaining controlled growth rate is key to a controlled process.

What is claimed is:

1. A method for depositing a film on a substrate, the method comprising:

(a) depositing a first deposition solution comprising a first deposition material on a substrate to form a first monolayer of said first deposition material;

(b) applying a rinse solution to the first monolayer for a period of time $t_{rinse}$ to form a rinse layer to remove excess first deposition material, wherein $t_{rinse} \leq 10$ seconds;

(c) reducing the thickness of said rinse layer to form a residual rinse layer having a thickness of between 0 microns and 5 microns; and (c) either:

i) depositing a second deposition solution comprising a second deposition material on said residual rinse layer for a period of time $t_{dep}$ to form a second monolayer of said second deposition material, where said residual rinse layer has a non-zero thickness; or ii) depositing said second deposition solution comprising said second deposition material on said first monolayer for a period of time $t_{dep}$ to form said second monolayer of said second deposition material, where said residual rinse layer is absent;

wherein $t_{dep} \leq -10$ seconds;

wherein said first monolayer and said second monolayer form a bilayer.

2. The method of claim 1, comprising repeating steps (a), (b), (c), and (d) to form a layer by layer assembled film comprising a plurality of bilayers.

3. The method of claim 1, wherein the residual rinse solution is less than 5 microns but greater than 500 nm in thickness.

4. The method of claim 1, wherein the first deposition solution and the second deposition solution are applied via a spray process.

5. The method of claim 1, wherein the formed half bilayer exhibits less than 3% variation in thickness over an area of at least 16 square inches.

6. The method of claim 1, wherein steps (b) and (c) are repeated z times to further remove unbound deposition material, wherein:

each repeat allows unbound first deposition material to diffuse away from the coating layer; and each repeat is independently carried out for a period of time $t_{rinse_x}$, where z is an integer index.

7. The method of claim 1, wherein $t_{dep}+t_{rinse}<10$ seconds.

8. The method of claim 1, wherein reducing the thickness of said rinse layer comprises application of an air knife, squeegee, nip roller, heat, vacuum, translational movement, ultrasonic energy, magnetic field, electric field, or a combination thereof to said rinse layer.

9. The method of claim 1, wherein reducing the thickness of the rinse layer is enhanced by addition of one or more additives to the rinse solution.

10. The method of claim 1, wherein:

the formed bilayer exhibits less than 3% variation in thickness over an area of at least 16 square inches.

11. The method of claim 1, wherein:

the second deposition solution is deposited via a spray process.

12. The method of claim 1, wherein:

depositing a second solution comprises depositing said second solution with a thickness ($d_{dep}$), wherein $d_{dep}$ is given by:

$$C_s/(C_B \cdot \text{eff}) \geq d_{dep} \geq (C_s/C_B)$$

and wherein $t_{dep}$ is given by:

$$t_{dep} > C_s^2/(C_B^2 \cdot D)$$

wherein:

$C_s$ is a desired 2-dimensional concentration per unit area of said second deposition material in said second monolayer;

$C_B$ is the bulk concentration per unit volume of said second deposition material in the second deposition solution;

$d_{dep}$ is the thickness of the layer of deposition solution on the surface;

eff is the transfer efficiency of deposition material and is greater than 0.03; and D is the diffusion coefficient of the second deposition material in the second deposition solution.

13. The method of claim 1, wherein the first deposition material comprises a polyelectrolyte and the second deposition material comprises nanoparticles.

14. The method of claim 1, wherein reducing the thickness of said rinse layer comprises removing the rinse layer.

15. The method of claim 12, wherein $C_s$ is the surface concentration based on randomly packed spheres where the areal coverage is between 0.45 and 0.54.

* * * * *